US009147362B2

(12) United States Patent
Znamenskiy et al.

(10) Patent No.: US 9,147,362 B2
(45) Date of Patent: Sep. 29, 2015

(54) DYNAMIC GAMUT CONTROL FOR DETERMINING MINIMUM BACKLIGHT INTENSITIES OF BACKLIGHT SOURCES FOR DISPLAYING AN IMAGE

(75) Inventors: Dmitry Nikolaevich Znamenskiy, Eindhoven (NL); Oleg Belik, Eindhoven (NL); Karel Johannes Gerhardus Hinnen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 301 days.

(21) Appl. No.: 13/501,113

(22) PCT Filed: Oct. 8, 2010

(86) PCT No.: PCT/IB2010/054555

§ 371 (c)(1),
(2), (4) Date: Apr. 10, 2012

(87) PCT Pub. No.: WO2011/045716

PCT Pub. Date: Apr. 21, 2011

(65) Prior Publication Data

US 2012/0194578 A1 Aug. 2, 2012

(30) Foreign Application Priority Data

Oct. 15, 2009 (EP) ..... 09173104

(51) Int. Cl.
*G09G 3/36* (2006.01)
*G09G 3/34* (2006.01)

(52) U.S. Cl.
CPC ..... *G09G 3/3413* (2013.01); *G09G 2300/0452* (2013.01); *G09G 2320/062* (2013.01); *G09G 2320/0646* (2013.01); *G09G 2320/0666* (2013.01); *G09G 2340/06* (2013.01)

(58) Field of Classification Search
CPC ..... G09G 3/3413
USPC ..... 345/102
See application file for complete search history.

(56) References Cited

U.S. PATENT DOCUMENTS

| | | | | |
|---|---|---|---|---|
| 2003/0151694 | A1* | 8/2003 | Lee et al. | 348/687 |
| 2004/0223005 | A1* | 11/2004 | Lee | 345/690 |
| 2005/0140612 | A1 | 6/2005 | Baek | |
| 2005/0219274 | A1* | 10/2005 | Yang et al. | 345/690 |
| 2005/0231534 | A1* | 10/2005 | Lee | 345/690 |
| 2006/0256053 | A1* | 11/2006 | Baek | 345/88 |
| 2007/0279372 | A1* | 12/2007 | Brown Elliott et al. | 345/102 |
| 2009/0092325 | A1* | 4/2009 | Brown Elliott et al. | 345/589 |
| 2009/0102769 | A1* | 4/2009 | Kouno et al. | 345/88 |
| 2009/0115803 | A1 | 5/2009 | Langendijk et al. | |

(Continued)

FOREIGN PATENT DOCUMENTS

| | | | |
|---|---|---|---|
| WO | 2007135642 | A1 | 11/2007 |
| WO | 2008035259 | A1 | 3/2008 |

*Primary Examiner* — Adam J Snyder

(57) ABSTRACT

A method of dynamic of gamut control is provided for a display having a multi-spectral (typically multi-color) backlight, and sub-pixels corresponding to the different backlight spectra and at least one common sub-pixel. The display may f be an RGBW display having an RGB backlight. The method includes iteratively calculating the minimum required backlight intensities that will allow all (selected) color points of an image to be represented by the display. The determination for a light source of the backlight is based on determinations of intensities determined for other light sources in a previous iteration.

20 Claims, 9 Drawing Sheets

(56) References Cited

U.S. PATENT DOCUMENTS

2009/0122073 A1* 5/2009 Higgins et al. ..... 345/590
2009/0122074 A1* 5/2009 Sung et al. ..... 345/690
2010/0020109 A1* 1/2010 Belik et al. ..... 345/690
2010/0033494 A1* 2/2010 Klompenhouwer et al. . 345/590

* cited by examiner

DYNAMIC GAMUT CONTROL FOR DETERMINING MINIMUM BACKLIGHT INTENSITIES OF BACKLIGHT SOURCES FOR DISPLAYING AN IMAGE

FIELD OF THE INVENTION

The invention relates to dynamic gamut control for a multi-primary display using a multi-spectrum backlight, such as e.g. a Light Emitting Diode (LED) display.

BACKGROUND OF THE INVENTION

Many display apparatuses display images on a display panel by use a light unit which comprises a backlight for illuminating variable light transfer pixels of a pixilated display panel. Usually, the pixilated display is a matrix display. Typically, the backlight provides a non-varying light spectrum and the input image is reproduced by modulating the optical state of the pixels such that the light transmission is modified to provide the desired intensity (intensities) for the pixel. Backlight sources have conventionally predominantly been provided by the use of fluorescent lamps. However, Light Emitting Diodes (LED's) have also been proposed for backlights. LEDs can provide almost monochromatic spectra and LED backlights are often used to provide a multi-colored backlight. A known transmissive Liquid Crystal Display (LCD) comprises pixels made of liquid crystal material of which an optical transmission is controlled in accordance with the image to be displayed. In another known reflective Digital Mirror Device (DMD) display, the pixels comprise small mirrors, which can tilt and where an angle of the tilt of the mirrors is controlled in accordance with the image to be displayed. Transflective displays, which partly reflect and partly transmit light from the light sources, are also known.

In a color display device, each one of the pixels comprises sub-pixels and associated color filters to obtain different colors that together provide the color of the pixel in accordance with the image to be displayed. The colored lights that leaves the color filters and which illuminate the associated sub-pixels are often referred to as the primary colors of the color display device. These primary colors define the color gamut that the display device can display.

Traditionally, color display devices have used three primary colors, such as typically Red (R), Green (G) and Blue (B). As a consequence, input images are typically defined in a three-component color space, which usually is the RGB color space or a color space related thereto. Recently, so called multi-primary displays have been introduced which use more than three primary colors. It should be noted that the term "colors" is used as a convenient term for light sources with different spectra that are not necessarily (but may be) substantially monochromatic. Such displays are also referred to as wide gamut displays because a wider color gamut can be displayed by using at least four instead of three primary colors.

Power consumption is one of the most important parameters of both low-end and high-end displays. Indeed, power consumption is an important issue in display apparatuses and much research has been undertaken to develop techniques for reducing the power consumption. Power consumption can be reduced not only in the backlight unit (light source efficiency and design, as well as driver electronics), but also by introducing different pixel layouts in the panel. One approach that has been proposed for a wide gamut display is to use four sub-pixels per pixel wherein one of the sub-pixels is white.

Usually, the other sub-pixels are red, green and blue, but other colors are possible, such as a saturated or desaturated yellow, cyan, a second blue etc.

For the same backlight intensity, the extra white sub-pixel (which has a substantially transparent color filter) has a much higher luminance than the other sub-pixels because the color filters between the light source and the other sub-pixels suppress a large part of the spectrum. Consequently, the power consumption can be minimized by providing the white part of the color via the white sub-pixel instead of via the other sub-pixels of the pixel. The transparent color filter need not be actually provided but often is present unintentionally because the light leaving the light source has to travel a predetermined distance through the transparent material covering the white sub-pixel.

Thus, an efficient RGBW (Red, Green, Blue, White) layout can be used which includes an additional fourth "white" sub-pixel (typically a sub-pixel without any color filter). If the pixel resolution and panel size remain the same, the sub-pixel apertures of an RGBW panel will be lower than for an RGB panel. However, as the white sub-pixel transmits all components of the backlight, its brightness can be approximated as the sum of the contributions by the red, green and blue filters thereby providing a potential doubling of the intensity of each color. This more than compensates for the reduced aperture and provides an effective aperture of each color which is typically around 50% higher than for the corresponding RGB panel, and thus can provide a total theoretical peak white brightness increase of 50%.

The use of multi-color backlights may thus not only provide an increased image quality but may also provide improved power efficiency. For example, RGBW panels can be particularly efficient if the single color backlight is replaced by colored backlight such as an RGB LED backlight. An example of such a display is shown in FIG. 1.

In particular, the use of a colored (e.g. LED) backlight, in addition to a better color reproduction, provides another important benefit in that it allows an independent control of R-, G-, and B-backlight channels. This may be used to substantially reduce the overall power consumption. For example, the LED channels that do not contribute a lot to image rendering can be dimmed thereby saving power.

This can be illustrated by FIG. 2 which illustrates two RGBW gamuts (with the 2D-projection on the R, G vector field being illustrated) for the same image content lacking saturated red colors. The color points of the image are represented by dots and FIG. 2 shows the color gamut for a white backlight compared to the reduced gamut that can be achieved by a multicolor backlight by reducing the backlight of the individual backlight channels to the lowest level that still allow all color points to be rendered. Thus, in the two examples the backlight is minimized at much as possible without incurring clipping. As can be seen the gamut induced by RGB backlight is more flexible and can be more accurately adapted to the specific image content thereby requiring less backlight resulting in reduced power consumption.

The determination of suitable colored backlight values for a given image is critical for both the image quality and the power consumption of the display. Unfortunately, this is a complex and resource demanding task as the impact of more than one sub-pixel must be considered for each backlight color. In particular, each primary color is dependent on at least two sub-pixels (typically the primary color sub-pixel and the white sub-pixel).

European Patent Application EP 06114488 and EP 07735967 proposes a technique for determining backlight intensities in such a scenario, and specifically for determining RGB backlight values for an RGBW display panel. In the publication, the backlight optimization problem is formalized as a search for the minimal backlight values that allow the picture content to be displayed without clipping artifacts. An efficient algorithm is provided for finding the backlight intensities. However, although a highly advantageous algorithm is proposed, it would be desirable for an even further improved approach. In particular, an approach having reduced computational demands, providing an improved performance, providing higher image quality, facilitating operation or implementation and/or providing improved performance would be advantageous.

SUMMARY OF THE INVENTION

Accordingly, the invention seeks to preferably mitigate, alleviate or eliminate one or more of the above mentioned disadvantages singly or in any combination. The invention is defined by the independent claims. The dependent claims define advantageous embodiments.

According to an aspect of the invention there is provided an method of dynamic gamut control for a display having a multi-spectrum backlight comprising a plurality of light sources with different spectra common for a plurality of pixels, the pixels of the plurality of pixels being formed by a group of sub-pixels, each sub-pixel corresponding to a transmission component illuminated by the multi-spectrum backlight, the transmission components for each pixel having particular transmission spectrums to provide a set of color primaries, wherein at least a first transmission component of the transmission components has a transmission spectrum such that an intensity of at least one of the color primaries depends on an intensity of at least two of the plurality of light sources, the method comprising determining a set of backlight intensities for the plurality of light sources by performing a sequence of iterations, each iteration comprising: for each of a set of color points of an image to be displayed determining (701) a color point backlight intensity set by for each light source of the light sources (LR, LG, LB) determining a minimum backlight intensity allowing a color of the color point to meet a representation criterion when backlight intensities of the light sources (LR, LG, LB) other than the each light source are that of a set of backlight intensities determined in a previous iteration for the colour point; and calculating the set of backlight intensities for the current iteration by selecting backlight intensities for each of the plurality of light sources from the color point backlight intensity sets such that a number of color points for which the color point backlight intensity set comprise a backlight intensity above a corresponding selected backlight intensity is below a threshold.

The invention may provide improved performance and/or facilitated implementation or operation. The invention may allow an improved driving of a multi-primary display panel using a multi-color backlight. In particular, power consumption may be reduced in many scenarios and/or improved image quality may be achieved. In many scenarios a significant computational resource reduction may be achieved which specifically may allow real time implementation of dynamic backlight control.

The approach may specifically use an iterative algorithm to determine substantially minimum intensity values for each backlight color thereby substantially minimizing the power consumption of the backlight and thus substantially reducing the power consumption of the display system as a whole.

Each of the colored light sources may correspond to a color primary for the display. Similarly, the transmission components may include a set of transmission components corresponding to the color primaries for the display. Specifically, the colored light sources may include a substantially Red, Green and Blue light source and similarly the transmission components may include a substantially Red, Green and Blue light filter transmission component. The first transmission component may specifically have a pass spectrum covering all color primaries of the display and may specifically provide substantially the same transmission coefficient for all of the light sources (and specifically may provides substantially the same attenuation for the channels of an RGB multi-color backlight).

In many embodiments, each light source may be substantially mono-chromatic and may specifically have 90% of the energy concentrated within 5% of the median frequency. Similarly, the transmission components may include a set of transmission components that are substantially mono-chromatic, and may specifically have 90% of the energy concentrated within 5% of the median pass frequency.

Any suitable representation criterion may be used to designate that a color point can be represented. Specifically, the criterion may be that the color of the color point is not clipped (or a number of particular color points result in predefined chromatic errors). For example, a criterion may require that the color point can be represented by the color gamut generated by the backlight and transmission components without any distortion.

The threshold may in some embodiments be a fixed/predetermined value. In other embodiments, it may be dynamically determined e.g. in response to varying characteristics. The threshold may be an absolute or relative value.

The method may allow the backlight intensities to be determined and thus the light sources controlled such that the minimum intensity values are used for which the set of color primaries provide an adjusted/reduced color gamut that still contains all the colors of the color points. The minimum backlight intensity value may be found by first, for each color point of the set of color points, determining the minimal intensity value of the color primary that is required to obtain the adjusted color gamut wherein the selected color point (or just color) of the set of colors point lies substantially on a boundary of the adjusted color gamut, and then selecting the maximum value of the determined minimum intensity values of the adjusted color primary for each one of the colors. The color may e.g. lie exactly on the boundary, and may e.g. in some embodiments have a small offset with respect to the boundary due to quantization errors. It has to be noted that the boundary may also comprise quantizing errors. Thus the minimum may e.g. be found such that the distance between the selected color and the boundary is minimal. An extra demand may be that the selected color must lie within the (quantized) boundary. In other embodiments other criteria may be used to define that a color point can be represented by the primaries.

Thus, the method of dynamic gamut control may decrease the backlight intensity of one of the color primaries one at a time such that the resulting color gamut becomes smaller due to the change of only one of the color primaries. In each iteration this may be done in parallel for each color primary based on the backlight intensities determined in previous iterations—or based on initial backlight intensities for the first iteration. The resulting color gamut of each iteration will typically decrease until it converges to a reduced gamut which however is still sufficiently large to sufficiently accurately present the image.

The iterative reduction of the gamut reduces the intensity of the color primaries and thus the power to be supplied to the light sources, while on the other hand ensuring that the gamut is not changed such that an (unacceptable) degradation of gamut results.

In accordance with an optional feature of the invention, the determining of a minimum backlight intensity for a first light source of the plurality of light sources comprises determining a minimum backlight intensity for the set of color points for each possible pair of the first colored light source and a different light source of the plurality of light sources; and selecting a highest minimum backlight intensity from the minimum backlight intensities for the set of color points for each possible pair. This may provide particularly advantageous gamut adjustment and may in particular facilitate operation and reduce computational requirements in many embodiments. In particular, it may simplify the determination of the impact of backlight intensity reductions as this may be considered pair wise for the backlight colors.

In accordance with an optional feature of the invention, the determination of a first minimum backlight intensity for the first colored light source and a second colored light source for a first color point comprises determining the first minimum backlight intensity as a function of a color point value corresponding to the first colored light source, a color point value corresponding to the second colored light source, a transmission coefficient for the first light source for a transmission component corresponding to the first light source, a transmission coefficient of the first transmission component for the first colored light source, a transmission coefficient of the first transmission component for the second colored light source, and a backlight intensity for the second colored light source determined in the previous iteration. This may provide particularly advantageous gamut adjustment and may in particular facilitate operation and reduce computational requirements in many embodiments. The parameters may allow a low complexity evaluation of the impact of a reduction of backlight intensities thereby providing a computationally efficient yet high performance gamut adjustment. The determination of the first minimum backlight intensity may specifically not consider any other image characteristics. The transmission coefficient is a transparency parameter for the transmission component indicating an attenuation characteristic of the light by the transmission component of the light from the light source.

In accordance with an optional feature of the invention, the determination of a first minimum backlight intensity for a first light source of the plurality of colored light sources for a first color point comprises determining the first minimum backlight intensity in response to:

$$\frac{v_1}{d_1 + c_1 \cdot \min\left(1, \frac{v_2}{c_2 K_2}\right)}.$$

wherein $v_1$ is a color point value corresponding to the first colored light source, $v_2$ is a color point value corresponding to a second colored light source, $d_1$ is a transmission coefficient for the first light source for a transmission component corresponding to the first light source, $c_1$ is a transmission coefficient of the first transmission component for the first colored light source, $c_2$ is a transmission coefficient of the first transmission component for the second colored light source, and $K_2$ is a backlight intensity for the second colored light source determined in the previous iteration. This may provide particularly advantageous gamut adjustment and may in particular facilitate operation and reduce computational requirements in many embodiments. The function may allow a low complexity evaluation of the impact of a reduction of backlight intensities thereby providing a computationally efficient yet high performance gamut adjustment. The determination of the first minimum backlight intensity may specifically not consider any other image characteristics. The transmission coefficient is a transparency parameter for the transmission component indicating an attenuation characteristic of the light by the transmission component of the light from the light source.

The function may be applied to all color points and all pair wise combinations of backlight light sources.

In accordance with an optional feature of the invention, the method further comprises the step of determining a set of backlight intensities by for each of the plurality of light sources determining a minimum backlight intensity allowing a corresponding color of all color points to be represented by light from only a single transmission component. This may allow an efficient initialization of the iterations and may specifically result in improved convergence.

In accordance with an optional feature of the invention, the threshold is one color point. This may provide improved image quality in many scenarios. The backlight intensities for the current iteration may specifically be selected such that all the color points can be represented. Specifically, the backlight intensities may be selected such that no color points are clipped, i.e. so the color primaries can represent all color points in accordance with the representation criterion and e.g. specifically without any degradation.

In accordance with an optional feature of the invention, the threshold is higher than one color point. This may provide increased flexibility and may in particular allow an improved control over the trade-off between image quality and power consumption. The backlight intensities for the current iteration may specifically be selected such that a number of color points cannot be represented in accordance with the representation criteria. Specifically, the backlight intensities may be selected such that a given number of color points are clipped, i.e. such that the color primaries can represent all color points without degradation except for a given number. The threshold may be a relative or absolute number.

In accordance with an optional feature of the invention, the method further comprises the step of determining the threshold in response to an image characteristic of the image to be displayed. This may provide increased flexibility and may in particular allow an improved control over the trade-off between image quality and power consumption. The approach may in many embodiments provide reduced power consumption with a reduced perceptual impact on the displayed image.

In accordance with an optional feature of the invention, the image characteristic is at least one of: a noise characteristic; a color characteristic; and a color distribution of the color points. This may allow improved performance in many embodiments and may in particular adapt the gamut and thus power reduction to the specific perceptual characteristics of the image.

In accordance with an optional feature of the invention, the threshold comprises a separate threshold for each of the plurality of light sources. This may facilitate operation and may reduce complexity in many embodiments. For example, a given number of color values may be clipped for each backlight light source.

In accordance with an optional feature of the invention, the method further comprises the step of determining the threshold as a fixed proportion of a number of color points in the set of color points. This may facilitate operation and reduce complexity in many embodiments while providing a high image quality.

In accordance with an optional feature of the invention, the threshold varies between iterations. This may provide improved performance in many scenarios.

According to an aspect of the invention there is provided an apparatus for dynamic gamut control for a display having a multi-spectrum backlight comprising a plurality of light sources with different spectra common for a plurality of pixels, the pixels of the plurality of pixels being formed by a group of sub-pixels, each sub-pixel corresponding to transmission components illuminated by the multi-spectrum backlight, the transmission components for each pixel having particular transmission spectrums to provide a set of color primaries, wherein at least a first transmission component of the transmission components has a transmission spectrum such that an intensity of at least one of the color primaries depends on an intensity of at least two of the plurality of light sources, the apparatus comprising a display driver for determining a set of backlight intensities for the plurality of light sources by performing a sequence of iterations, each iteration comprising: for each of a set of color points of an image to be displayed determining (701) a color point backlight intensity set for each light source of the light sources (LR, LG, LB) determining a minimum backlight intensity allowing a color of the color point to meet a representation criterion when backlight intensities of the light sources (LR, LG, LB) other than the each light source are that of a set of backlight intensities determined in a previous iteration for the colour point; and calculating the set of backlight intensities for the current iteration by selecting backlight intensities for each of the plurality of light sources from the color point backlight intensity sets such that a number of color points for which the color point backlight intensity set comprise a backlight intensity above a corresponding selected backlight intensity is below a threshold.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF EMBODIMENTS

Figure 1:
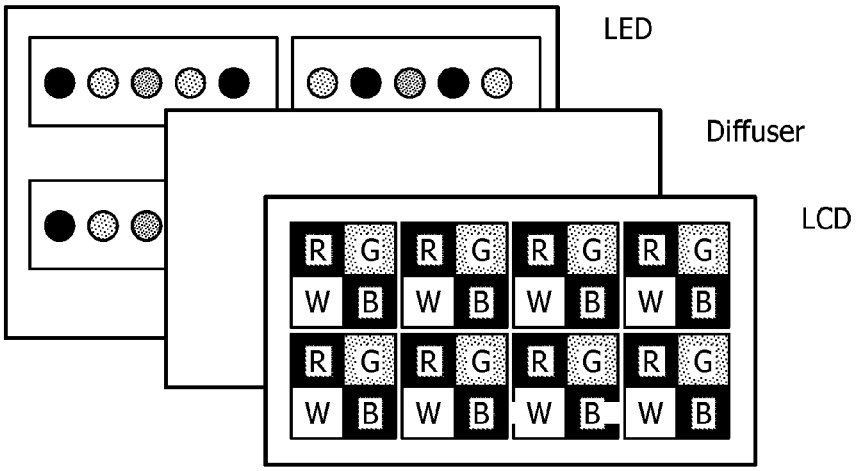
FIG. 1 is an illustration of elements of an RGBW display panel.
Figure 2:
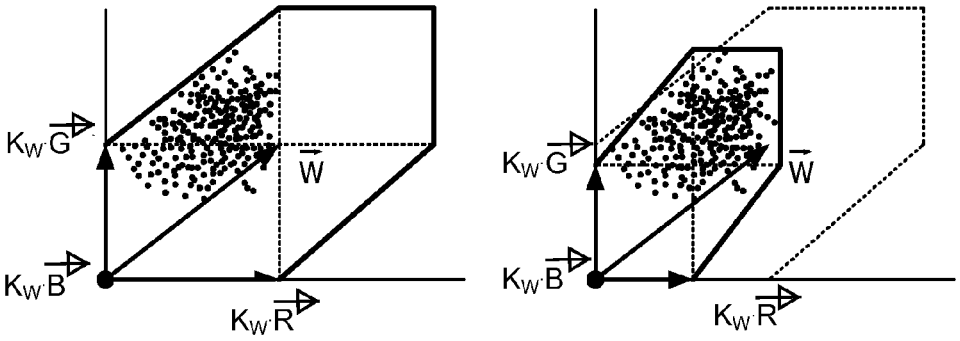
FIG. 2 is an illustration of elements of a gamut minimization for a backlight display panel.
Figure 3:
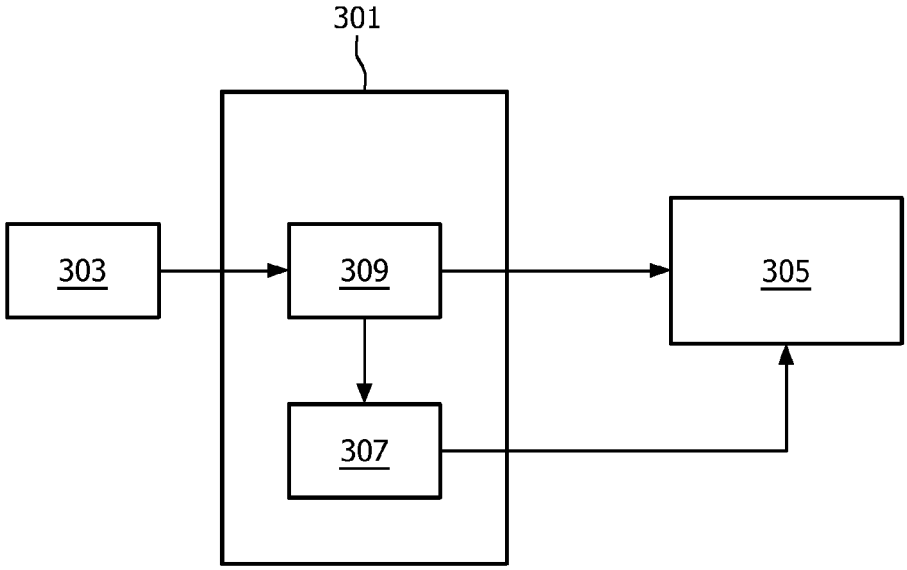
FIG. 3 is an illustration of an example of a display system in accordance with some embodiments of the invention.

FIG. 3 illustrates an example of a display system for presenting images in accordance with some embodiments of the invention. The system comprises a display driver 301 which receives images to be displayed from an image source 303 which may be any suitable source providing still or moving images. The images may specifically be provided as digital images wherein each pixel is represented by a set of intensity values for a set of color primaries. In the specific example, the images are provided as (or can be converted to) uncompressed digital images wherein each pixel is represented by a Red, Green, and Blue value (an RGB value).

The display driver 301 is coupled to a backlight display panel 305 which displays the received images. The backlight display panel 305 comprises a multi-spectrum and specifically a multi-color backlight which generates a backlight for a transmission layer that for each individual (sub)pixel can vary the light transparency such that the desired image can be presented. The display driver 301 comprises a backlight controller 307 which controls the backlight intensity and which can generate individual drive signals for each spectrum/color of the backlight thereby allowing the backlight intensities of the individual spectra/colors to be set separately. The backlight intensity setting is common for a group of pixels which in the specific examples corresponds to the entire display. Thus, the same backlight intensities are in the example provided across the entire display. In other embodiments, the backlight may be individually settable for different areas of the display (in which case the following approach may be applied individually to each backlight area). However, the backlight intensity is common for a group of pixels which is typically relatively large.

The display driver 301 further comprises an image controller 309 which controls the transparency of the transmission layer that attenuates the backlight to provide the desired image. The transmission layer comprises a set of transmission components for each pixel of the image where each transmission component corresponds to a sub-pixel of the pixel. The different sub-pixels correspond to different spectra of the radiated light and specifically correspond to the different color primaries of the display. Each sub-pixel transmission component may specifically comprise a color (more generally a frequency spectrum) filter that filters the desired light from the backlight. The filtered light may then reach a light attenuation element which attenuates the light from the filter element by a value required to provide the desired intensity for the sub-pixel. The image controller 309 thus generates drive values for each transmission element of a pixel such that the desired color and intensity of the pixel is achieved by the combination of the light from the sub-pixels. It will be appreciated that the color filters may be common for a plurality of pixels.

In the specific example, the backlight comprises N different light sources which provide light with different spectra where each spectrum corresponds to a color primary. In the example, the light sources are substantially mono-chromatic such that the energy of the radiated light for each light source is concentrated in a relatively small frequency band (corresponding to a color). The light sources may specifically be sufficiently concentrated in the frequency domain for at least 90% of the energy to be concentrated within 5% of the median frequency.

Similarly, in the example each pixel comprises a number of sub-pixels formed by transmission elements that have a concentrated and substantially monochromatic transmission spectrum. Specifically, the transmission elements for a pixel may include a set of transmission elements for which the transparency for one of the light sources is at least five to ten times higher than for any of the other light sources. This will ensure an efficient generation of a color primary for the display. Specifically, a set of color primaries are generated by sub-pixels having matching transmission elements and light source spectra. In the specific example, this approach provides an efficient generation of RGB color primaries based on RGB backlight and RGB transmission elements.

In addition, the transmission elements of the display panel 305 also comprises at least one transmission element which has a transmission spectrum such that the intensity of the color primaries generated by the transmission element depends on an intensity of at least two of the plurality of light sources. Specifically, the attenuation of the light from the different light sources of the backlight (the different colors in the specific example) may be substantially the same, and may specifically differ by less than 3 dB or even 1 dB in some scenarios. In the specific example, each pixel includes one sub-pixel corresponding to such a transmission element. Furthermore, this transmission element does not include any filtering component and thus provides a substantially flat transmission spectrum allowing each backlight spectrum to pass substantially identically. Indeed, in the specific example the sub-pixel is used to provide a white color primary by providing a substantially equal attenuation of the different colors of the RGB backlight. Thus, the specific example provides pixels that each consist of four sub-pixels corresponding to the four color primaries Red, Green, Blue and White (RGBW) based on a backlight comprising Red, Green and Blue (RGB) light sources.

Figure 4:
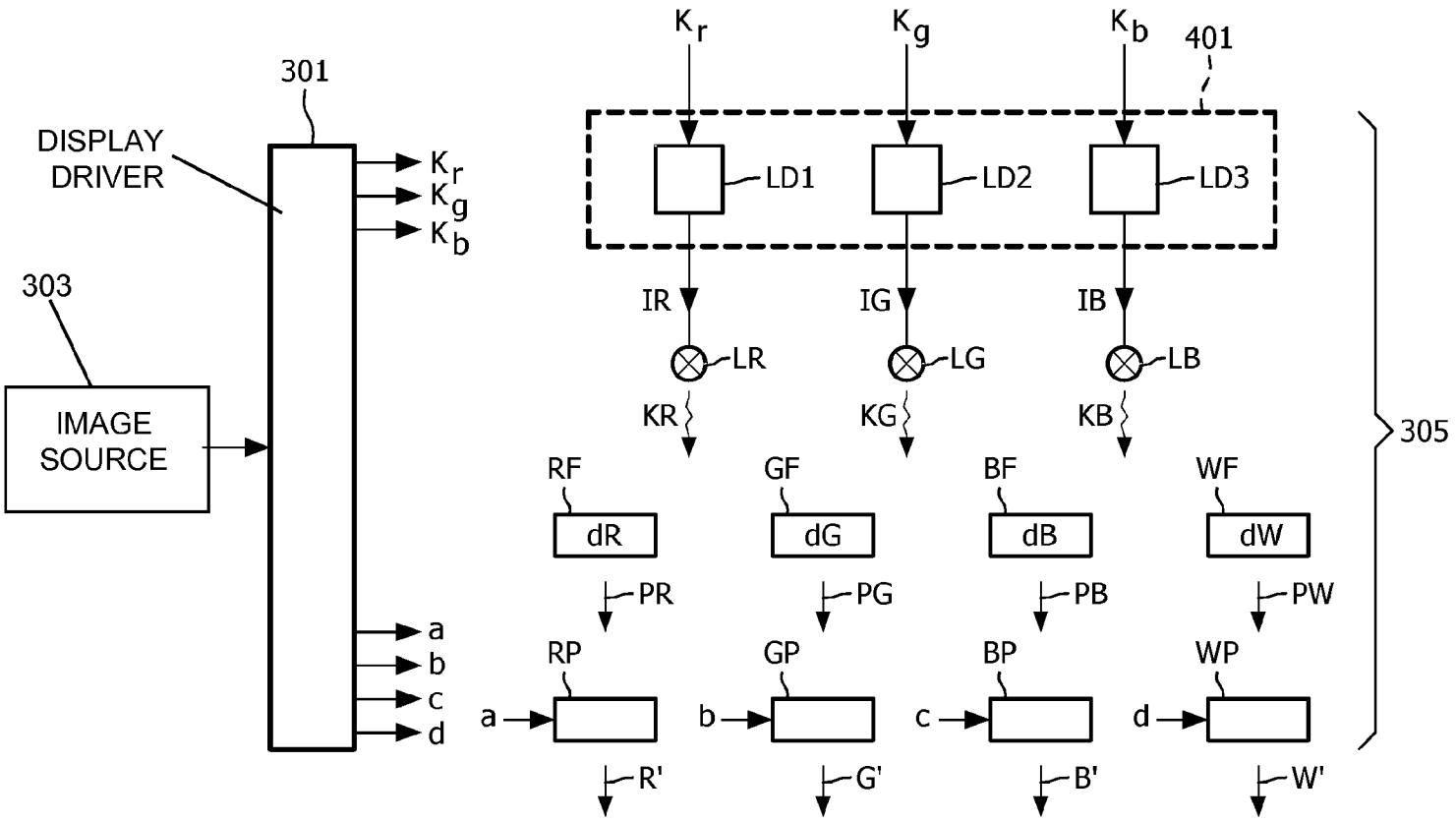
FIG. 4 is an illustration of an example of a display system in accordance with some embodiments of the invention.

FIG. 4 illustrates the display driver 301 and the display panel 305 in more detail. The system uses N color primaries, which are generated by P light sources via N color filters, which have a particular transmission. In FIG. 4 an example is shown with N=4 primaries PR, PG, PB, PW, three light sources LR, LG, LB, and four color filters RF, GF, BF, WF. For clarity and brevity, the following description will focus on this specific example but it will be appreciated that the described principles are equally applicable to a general case for N primaries, P light sources, and N color filters.

The color primaries PR, PG, PB, PW generated by the color filters RF, GF, BF, WF illuminate the associated attenuation elements RP, GP, BP, WP, corresponding to the different sub-pixels of a pixel of the display device 305. The optical state of the attenuation elements RP, GP, BP, WP and thus the sub-pixels is controlled by the control signals a, b, c, d, respectively, in accordance with the image to be displayed. The control signals a, b, c, d modulate the color primaries PR, PG, PB, PW to provide the intensity of the light R', G', B', W' leaving the sub-pixels RP, GP, BP, WP required to obtain the color of the associated pixel in the input image. It has to be noted that in a practical implementation the color filters RF, GF, BF, WF may alternatively be present below the attenuation elements RP, GP, BP, WP.

In the embodiment shown in FIG. 4, N is four and P is three. However, any other numbers of N and P may be used as long as N is larger than two, and P can be any number, but mostly smaller than or equal to N. Although the capital letters R, G, B, W indicate the colors red, green, blue and white respectively, any other backlight sources having different spectra may be used. The spectrum of the white color W may be the sum of the spectra of the other colors R, G, B filtered by the white filter WF. For the ease of explanation, the display device 305 is in the following considered to be an RGBW display which has red, green, blue and white primaries PR, PG, PB and PW, respectively. However, the skilled person will readily understand that the described approach may be used with any other display having other primaries.

It should be noted that the white primary PW is referred to as white because the white filter WF can be transparent for all the visible light wavelengths. The transmission dW of the white filter WF may be 100% for all the wavelengths. However, in most practical implementations, the white sub-pixel WP is covered by a transparent layer with a particular transmission spectrum and thus a transmission smaller than 100%, which is different for different wavelengths. For example, the white filter WF may transmit yellow or other spectra. Also, the use of the word "white" is only related to the fact that the white filter WF is transparent; the actual color of the white primary PW depends on the actual intensities of the light sources LR, LG, LB and thus may have any color.

The display panel 305 further comprises a backlight driver 401 which comprises the sub-drivers LD1, LD2 and LD3 for the individual light sources (corresponding to the different colors or spectra of the backlight). The sub-driver LD1 receives an input control value Kr and supplies the drive signal IR to the light source LR which produces red light with an intensity KR. The sub-driver LD2 receives an input control value Kg and supplies the current IG to the light source LG, which produces green light with an intensity KG. The sub-driver LD3 receives an input control value Kb and supplies the current IB to the light source LB, which produces blue light with an intensity KB. The light sources LR, LG, LB may be separate lamps, such as for example fluorescent lamps, or LED's (Light Emitting Diodes) or groups of LED's. The input control values Kr, Kg, Kb may control the current IR, IG, IB supplied to the light sources LR, LG, LB by varying a level and/or a duty-cycle of these currents IR, IG, IB. The display driver 301 receives the input image and supplies the control values Kr, Kg, Kb and the control signals a, b, c, d for the individual sub-pixels. The specific processing is not further described as it will be well known how to drive a conventional RGBW display.

The following will describe a method of controlling the backlight intensities of the different light sources (spectra/colors) of the backlight such that power may be reduced while still maintaining a desired image quality. Specifically, reduced backlight intensities are determined which however still maintain a suitable gamut of the color primaries for the specific image being displayed. The processing may e.g. be performed by dedicated hardware or by a software program running on a microprocessor.

Figure 5:
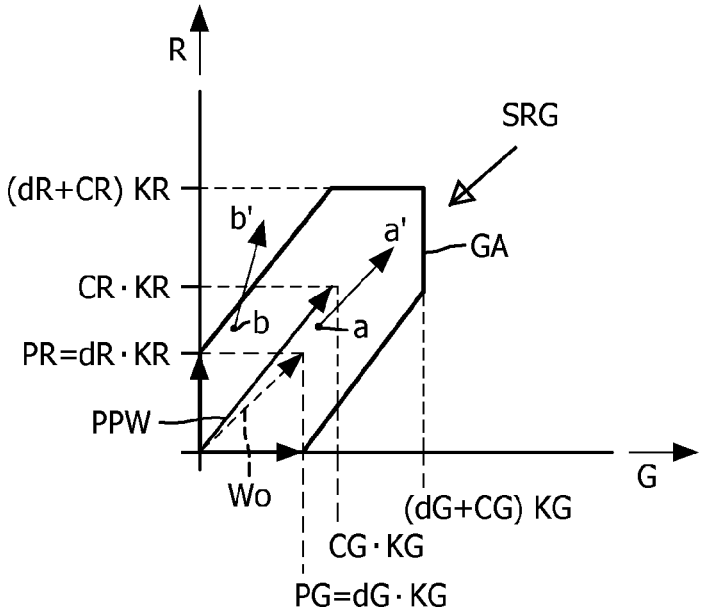
FIG. 5 is an illustration of a two-dimensional gamut for an RGBW display.

FIG. 5 schematically shows a two-dimensional gamut to elucidate the effect of boosting the primaries in an RGBW display by the inclusion of the additional W primary in comparison to an RGB display. This two-dimensional gamut is a projection gamut of the four-dimensional gamut created by the four primaries PR, PG, PB, PW. If N primaries are used, this two-dimensional gamut is a projection-gamut of the N-dimensional gamut defined by the N primaries. For simplicity, the approach is elucidated with respect to two-dimensional projections of the N-dimensional gamut.

FIG. 5 shows the RG sub-space SRG. In an RGBW display with the three controllable light sources LR, LG and LB, besides the RG sub-space SRG, two other sub-spaces (not shown) can be defined: the RB sub-gamut and the GB sub-gamut. The vertical axis of the RG sub-space shows the intensity of the red color, and the horizontal axis shows the intensity of the green color. The red primary vector PR, which lies on the vertical axis has a length PR=dR·KR, wherein KR represents the intensity of the light generated by the red light source LR, and wherein dR is the filter transmission factor of the red filter RF. The green primary vector PG, which lies on the horizontal axis has a length PG=dG·KG, wherein KG is the intensity of the light generated by the green light source LG, and wherein dG is the filter transmission factor of the green filter GF. The component of the white primary PW projected from the three-dimensional RGB color space to the two-dimensional RG color space is indicated by PPW. The white primary PPW is defined by:

$$PPW=KR\cdot dW1+KG\cdot dW2+KB—dW3=CR\cdot KR+CG\cdot KG+CB\cdot KB.$$

where dW1, dW2, dW3 indicate the spectral filtering of the white filter WF. Thus the filter factor dW shown in FIG. 5 may depend on the wavelength of the impinging light. It is assumed that the white filter WF has a constant or almost constant transmission CR, CG, CB, for the red light KR, the green light KG and the blue light KB, respectively. Thus the white vector PPW ends at the points: G=CG·KG and R=CR·KR. The total sub-gamut GA of colors, which can be reproduced by the primaries in the red-green sub-space SRG is defined by the vectors PR, PG and PPW and is indicated by GA. It has to be noted that the white primary PW need not be white; the actual color depends on the coefficients CR, CG and CB and on the intensities KR, KG and KB. Consequently, the white vector PPW, which is the projected white primary PW, need not coincide with the projected white WD, which is obtained when all the primaries PR, RG, RB have intensity one.

If the RGBW display has a same resolution as an RGB display device, the RGBW sub-pixels have reduced area with respect to the RGB sub-pixels. Dependent on the transmission dW of the white filter and the color of to be displayed, a 50% higher brightness, or a 50% lower power consumption at the same brightness is possible in a RGBW display with respect to a RGB display. However, the use of RGBW displays with fluorescent lamps as the backlight is limited due to artifacts caused by the RGB to RGBW gamut mapping. In order to make use of the full brightness of the RGBW gamut, the input image has to be scaled approximately by a factor of two. Thus, all colors become a factor two brighter, see for example the unsaturated color a which becomes a', and the saturated color b which becomes b'. Consequently, the scaling causes some saturated colors to move outside of the gamut GA that can be reproduced. This leads to undesirable clipping artifacts or unnaturalness after mapping such colors back into the reproduction gamut GA.

The gamut GA can be enlarged by boosting the light sources LR, LG, LB with the same scaling factor and thus enlarging the vectors PR, PG and PPW until all possible input colors can be reproduced by the gamut GA. However, such an approach would of course increase the power consumption enormously.

If a single fluorescent lamp is used for the light sources LR, LG, LB, the primaries PR, PG, PB and PW are equally enlarged, thereby increasing the luminance while preserving hue and saturation. In this example the light sources LR, LG, LB are not separate light sources but are obtained by different phosphors in the same fluorescent lamp. This approach avoids clipping but increases the power consumption and lowers the lifetime of the lamp. If the light sources LR, LG, LB are e.g. separate LEDs or LED arrays, the brightness of the LEDs can be controlled separately. This degree of freedom is used by the current approach to separately control the luminance of the lights KR, KG, KB to adapt the shape of the resulting gamut such that these luminances are minimal while still allowing all (or in some embodiments most) colors of the actual input image to be reproduced. This gamut control is dynamic as it adapts the gamut dependent on the colors comprised in the actual input image, part of the input image, or a set of input images.

Figure 6:
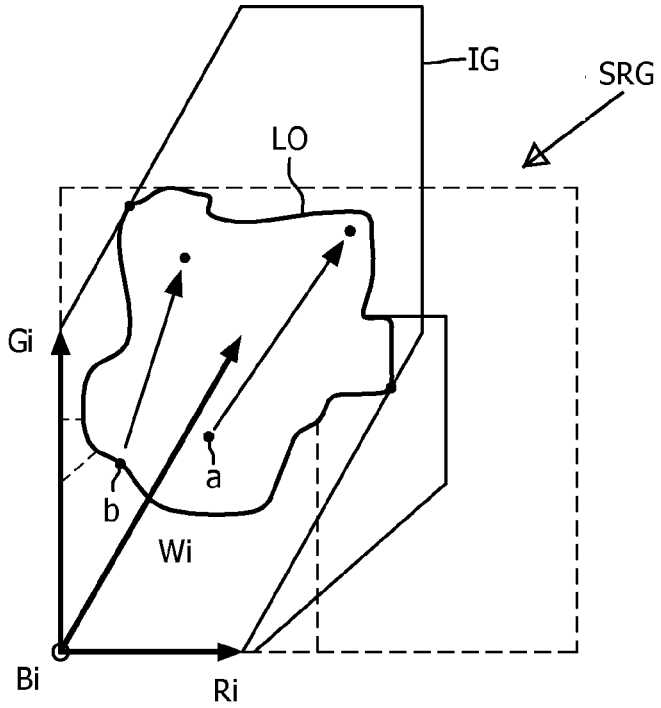
FIG. 6 is an illustration of a two-dimensional gamut for an RGBW display.

FIG. 6 schematically shows a two-dimensional gamut to elucidate the effect of boosting and dimming the primaries in an RGBW display for minimizing the power consumption while all colors in the input image are within the gamut. Dependent on the color content of the input image the primaries may be scaled differently. In FIG. 6, none of the colors of the input image fall outside the area bounded by the locus LO. Some of the colors are indicated by a dot. The intensities of the light sources LR, LG, LB are controlled such that the primaries PR, PG, PB and PW have the minimal values Ri, Gi, Bi and Wi causing a gamut IG which is as small as possible but which still encompasses all the colors of the input image. For the sake of simplicity, in FIG. 6 only red and green colors are present in the input image such that the blue primary PB is zero.

This approach of boosting and dimming of the primaries has two advantages: first no artifacts will occur because none of the colors of the input image is outside the reproduction gamut IG (or alternatively only an acceptable and controllable amount of artifacts are introduced by only allowing a small and controlled number of colors to not be representable), and secondly, the intensity KR, KG, KB of the light sources LR, LG, LB is minimal and thus the power consumption is minimal. Such a dynamic gamut control is used in the system of FIGS. 3 and 4.

Figure 7:
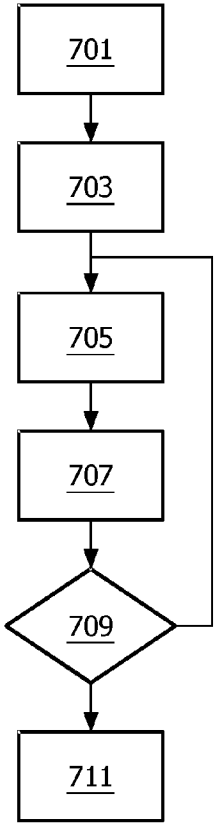
FIG. 7 is an illustration of an example of a method of dynamic gamut control for a display system in accordance with some embodiments of the invention.

FIG. 7 illustrates a flow chart for an example of a method of dynamic gamut control for a display in accordance with some embodiments of the invention.

The method initiates in step 701 wherein a set of color points is selected from the input image. Each color point represents a color that is comprised in the input image. Specifically, the color of each pixel may be considered to correspond to a color point in the color space defined by the multi-spectrum backlight, and thus in the specific example each color point may correspond to a color of a pixel in the RGB color space formed by the RGB backlight. The selected color points may specifically consist in all the color points that are present in the image, and specifically in all the pixel colors of the input image. In some embodiments a subset of the color points/pixels may be selected, such as for example only every X'th pixel or only pixels having at least one RGB value above a threshold. Such reduced color point sets may be used to reduce the computational requirements.

Step 701 is followed by step 703 wherein an initial set of values for the intensities for the light sources of the backlight are set. In some embodiments, the initial backlight intensities may simply be set to the maximum intensity values possible. However, in the specific example, the initial backlight intensity for each light source (color) is determined as the intensity which is required to provide the desired light from the pixel based only on the light source and the corresponding transmission element. Thus, the red backlight intensity is determined as the intensity which can provide the desired red light from the pixel based only on the red sub-pixel and ignoring any contribution from the green, blue and in particular the white sub-pixels (in most embodiments any contribution from the green and blue sub-pixels would be negligible).

Thus, in step 703 an initial color point backlight intensity set comprising initial values for the backlight intensities is determined.

Step 703 is followed by a set of iterations which proceed to further refine the color point backlight intensity set to reduced backlight intensities that however still allow a sufficient number of the color points to be represented by the display. This is achieved by iteratively for each color point calculating the backlight intensity that is required for each backlight light source under the assumption that the other light sources have an intensity as determined in previous iterations, i.e. that the other light sources have an intensity corresponding to the values in the stored color point backlight intensity set.

Specifically, the method includes an iteration of the determination of the color point backlight intensity set where each iteration comprises a further iteration over all the color points. For each of the color points, the minimum intensity value for each of the colored light sources that is required for the color point to be representable is calculated based on the assumption that all the other color sources have the value reflected in the current color point backlight intensity set. E.g. the minimum required red backlight intensity is calculated assuming that the green and blue backlights have the intensities that were calculated in the previous iteration.

This approach provides for a very efficient computation and specifically allows all light source intensities to be calculated in parallel for each individual color point. Thus, a separate and sequential iteration over all color points for each light source is not necessary. This further provides a high efficiency as some of the parameters and calculations for each color point can be reused for the different light sources.

It will be appreciated that different criteria for the color point to be considered as representable can be applied. Specifically, the requirement may be that the color point is within the gamut of the display (assuming the other light sources have the previously determined intensity), i.e. it may be a requirement that no colors are clipped or distorted. However, in other embodiments, a requirement may be that the color points do not exceed the gamut by more than a certain value thereby allowing some color distortion/clipping to be accepted in return for a reduced power consumption. As other examples, it may be required that all colors have a given margin to the resulting gamut etc.

Thus, step 703 is followed by step 705 wherein a color point backlight intensity set is determined for each of the color points. The color point backlight intensity set for a color point contains the minimum intensity value for each of the backlight light sources that allow the color to be represented (in accordance with the desired criterion). Thus, in the specific example, the color point backlight intensity set for a given color point contains the RGB intensity values KR, KG, KB (or equivalently the drive values Kr, Kg, Kb) that will allow the color of the color point to be represented by the color primaries of the display, i.e. to be within the gamut represented by the intensity values.

Figure 8:
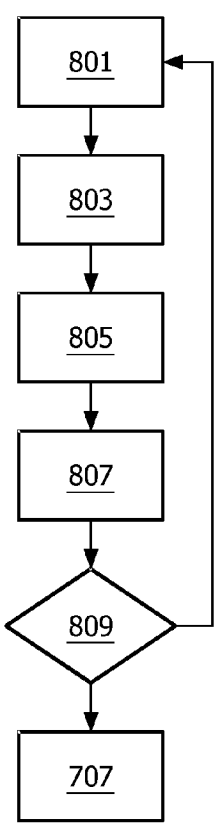
FIG. 8 is an illustration of an example of some steps of a method of dynamic gamut control for a display system in accordance with some embodiments of the invention.

FIG. 8 illustrates step 705 in more detail. The step initiates in step 801 wherein the next color point from the set of color points is selected. Step 801 is followed by step 803 wherein the required minimum Red backlight intensity value in order to represent the specific color point is calculated. This calculation is based on an assumption that the Green and Blue backlights have the intensities that were calculated in the previous iteration (or were determined as the initial values). Step 803 is followed by step 805 wherein the required minimum Green backlight intensity value in order to represent the specific color point is calculated. This calculation is based on an assumption that the Red and Blue backlights have the intensities that were calculated in the previous iteration (or were determined as the initial values). It is thus not dependent on the Red backlight intensity value that was calculated in step 803 of the current iteration. Step 805 is followed by step 807 wherein the required minimum Blue backlight intensity value in order to represent the specific color point is calculated. This calculation is based on an assumption that the Red and Green backlights have the intensities that were calculated in the previous iteration (or were determined as the initial values). It is thus not dependent on the Red or Green backlight intensity values that were calculated in steps 803 and 805 of the current iteration.

Step 807 is followed by step 809 wherein it is determined whether all color points have been processed. If not, the method returns to step 801 to process the next color point. Otherwise the method proceeds to step 707.

Thus, at step 707 a color point backlight intensity set comprising minimum backlight intensities have been determined for each individual color point. Thus, a number (corresponding to the number of color points) of color point backlight intensity sets have been calculated with each set comprising the minimum backlight values that allow the color point to be represented, i.e. with each set defining the necessary backlight intensities for that color point. The method then proceeds in step 707 to determine a set of backlight intensities for the current iteration by selecting intensities from the plurality of color point backlight intensity sets. Specifically, the backlight intensities are selected such that the number of color point backlight intensity sets that comprise a backlight intensity above a corresponding selected backlight intensity is below a threshold. A backlight intensity above a corresponding selected backlight intensity is indicative of the color point not being representable in accordance with the representation criterion and may specifically be indicative of a distortion or clipping of the color primary for that color point and thus the introduction of an artifact.

The threshold may specifically be one which will require that all of the color point backlight intensity set have backlight intensities below (or equal to) the selected intensity values. Thus, in this example, the backlight intensities are selected as the maximum value of the individual backlight intensities of the color point backlight intensity sets determined in step 707. Thus ensures that all the color points can be represented in accordance with the representation criterion and specifically that all color points are within the resulting gamut. Thus, at the end of step 707 a set of backlight intensities is determined which will ensure that the color points can be displayed appropriately while reducing the power consumption.

The backlight intensities are determined based on the set of backlight intensities of the previous iteration and may therefore not precisely reflect the simultaneous intensity changes for the different light sources. Accordingly, the method may proceed to iterate steps 705 and 707. Specifically, step 707 is followed by step 709 wherein it is determined whether more iterations should be performed. If so, the method returns to step 705. Otherwise the method proceeds to step 711 wherein the calculated backlight intensities are applied to the display panel and the transparency of the transmission components required for each sub-pixel for the applied backlight intensities are calculated and applied.

Thus, the method uses an iterative approach to gradually converge the color gamut of the display to the specific distribution of the color points. This ensures low power consumption while maintaining a high image quality. Furthermore, it has been found that only very few iterations are required to provide acceptable results. Indeed in many embodiments two iterations will be sufficient.

Furthermore, the calculation of the individual backlight intensity values within one iteration (within one operation of step 705 and step 707) is independent of the calculation of any of the other backlight intensity values in that iteration and is only independent on the intensity values of the calculations in the previous iteration. This allows increased computational efficiency and specifically allows the calculations to be independent and be performed separately and in any order. For example, steps 803-807 may be performed in any sequence or indeed in parallel. Also, the calculation of the color point backlight intensity set for a given color point is not dependent on the selection of backlight intensity values over the set of color points and accordingly all backlight intensities for a color point backlight intensity set can be determined simultaneously for a given color point thereby avoiding the need for a sequential iteration over all color points for each of the backlight light sources. Furthermore, as will be demonstrated subsequently a number of calculations and parameters may be reused for the calculation of the individual backlight intensities. Accordingly, the described approach may provide a computationally highly efficient gamut control.

In the following, a specific example of a gamut control operation in accordance with some embodiments of the invention will be described. The specific example corresponds to the system of FIG. 4 and thus has an RGB backlight generating four color primaries, namely RGBW. In the specific example, no clipping is introduced i.e. the method seeks to determine the minimum gamut for which all of the color points can be represented without distortion.

Firstly, the backlight reduction/minimization problem is described using a formal mathematical notation.

Let $K_R$, $K_G$, $K_B$ be the luminance of the R, G, and B backlight LEDs, and let $d_RK_R$, $d_GK_G$, $d_BK_B$ indicate the luminance of the LEDs after application of the R, G, and B color filters of the display where $d_R$, $d_G$, $d_B$ are transparency parameters. Since the W-color filter can be more or less transparent to red light than the R-color filter we define scaling parameter $c_R$, so that the luminance of red LEDs after application of the W-color filter is $c_RK_R$. Similarly we define scaling parameters $c_G$ and $c_B$, i.e. $c_G$ indicates the relative transparency of the W-color filter with respect to green LEDs, and $c_B$ of the W color filter with respect to blue LEDs.

With any $K_R$, $K_G$, $K_B$ we associate a gamut $G(K_R, K_G, K_B)$ as the set of colors in RGB linear space which can be achieved by different combinations of LCD shutters applied to the R-, G- B- and W-primaries, i.e. by the variable attenuation of the attenuation elements of the transmission elements.

In mathematical language $G(K_R, K_G, K_B)$ is a linear span $$\sum_{i=1}^{4} \alpha_i \vec{X}_i \in \mathbb{R}^3$$

restricted to $\alpha_i \in [0,1]$, on vectors (primaries) $\vec{X}_1 = d_RK_R\vec{e}_R$, $\vec{X}_2 = d_GK_G\vec{e}_G$, $\vec{X}_3 = d_BK_B\vec{e}_B$, $\vec{X}_4 = c_RK_R\vec{e}_R + c_GK_G\vec{e}_G + c_BK_B\vec{e}_B$. We call the gamut $G(K'_R, K'_G, K'_B)$ smaller or equal than the gamut $G(K_R, K_G, K_B)$ and write $G(K'_R, K'_G, K'_B) \leq G(K_R, K_G, K_B)$, if it requires less bright primaries, i.e. $K'_R \leq K_R$, $K'_G \leq K_G$, and $K'_G \leq K_G$.

The power consumption of a display can be approximated as $$P_{disp} = p_RK_R + p_GK_G + p_BK_B,$$

where $p_R$, $p_G$, $p_B$ are display dependent parameters. Hence the power minimization problem can be reformulated as the search for minimal backlight intensities $K_B$, $K_G$, $K_B$ that allow the reproduction of content without clipping artifacts. Therefore, we call gamut $G(K_R, K_G, K_B)$ minimal for a set of color points S, if 1) S is contained in $G(K_R, K_G, K_B)$, 2) the backlight cannot be reduced further without loosing the first property, i.e. for any gamut $G(K'_R, K'_G, K'_B)$, if $S \subseteq G(K'_R, K'_G, K'_B)$ and $G(K'_R, K'_G, K'_B) \leq G(K_R, K_G, K_B)$, then $G(K'_R, K'_G, K'_B) = G(K_R, K_G, K_B)$.

The following theorem states that there exists only one triple $K_R$, $K_G$, $K_B$ that satisfies the above two properties and therefore the power minimization problem has a unique solution.

Theorem 1 The minimal gamut for set of colors S is unique.

The following section is directed to the proof of Theorem 1.

In order to prove Theorem 1 and find the minimal gamut we need to define projections of gamut $G(K_R, K_G, K_B)$ on plains RG, RB, and GB defined by combinations of the primary vectors $\vec{e}_R$, $\vec{e}_G$ and $\vec{e}_B$.

Figure 9:
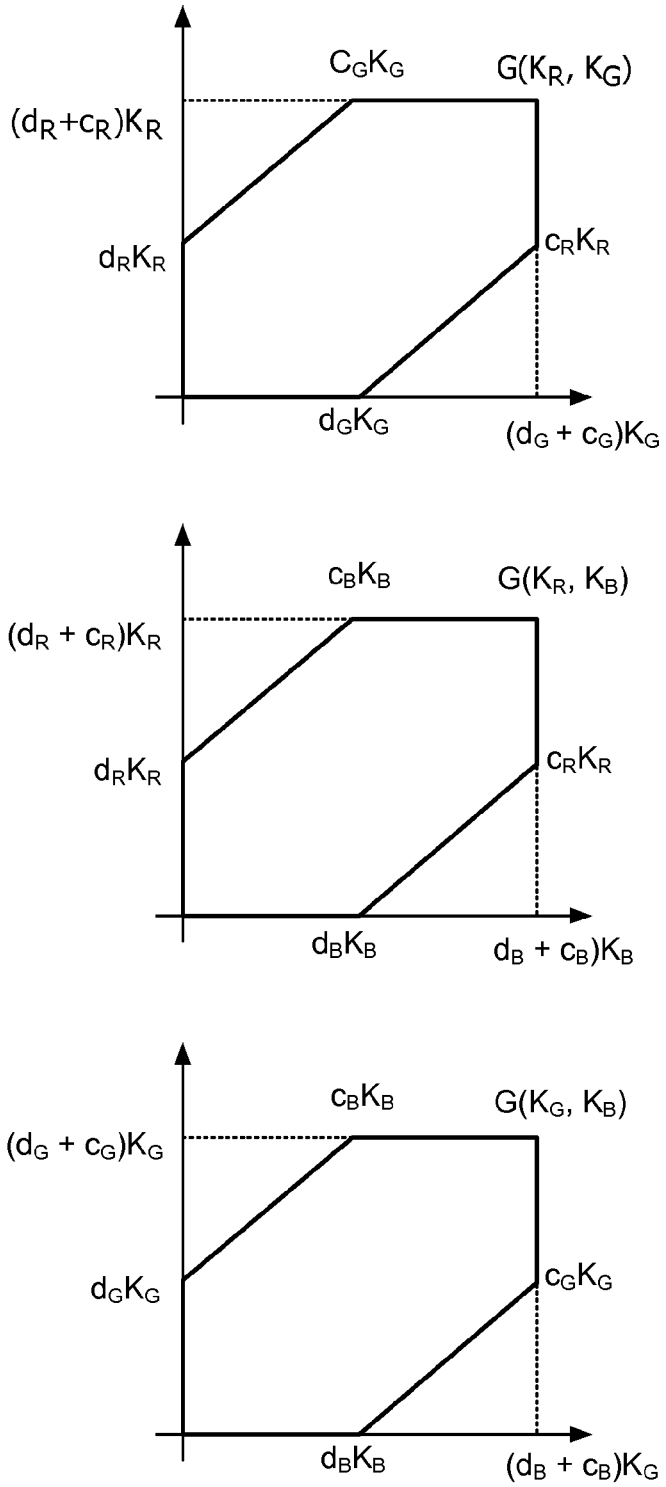
FIG. 9 is an illustration of some two-dimensional gamut for an RGBW display.

Let $G(K_R, K_G)$ denote the projection of $G(K_R, K_G, K_B)$ on the plain RG, i.e. $G(K_R, K_G)$ is a linear span $$\sum_{i=1}^{3} \beta_i Y_i \in \mathbb{R}^2$$

restricted to $\beta_i \in [0,1]$, on vectors (primaries) $\vec{Y}_1 = \vec{X}_1 = d_RK_R\vec{e}_R$, $\vec{Y}_2 = \vec{X}_2 = d_GK_G\vec{e}_G$, $\vec{Y}_3 = c_RK_R\vec{e}_R + c_GK_G\vec{e}_G$. Similar we define $G(K_R, K_B)$ and $G(K_G, K_B)$ as projections on plains RB and GB as illustrated in FIG. 9 which shows $G(K_R, K_G)$, $G(K_R, K_B)$ and $G(K_G, K_B)$ are projections of $G(K_R, K_G, K_B)$ on plains RG, RB and GB.

Postulate 1: An arbitrary color point (r, g, b) belongs to $G(K_R, K_G, K_B)$ if and only if the following conditions are satisfied:

1) point (r,g) is in $G(K_R, K_G)$, 2) point (r,b) is in $G(K_R, K_B)$, 3) point (g,b) is in $G(K_G, K_B)$.

Lemma 1: For any two gamuts $G(K_R, K_G, K_B)$ and $G(K''_R, K''_G, K''_B)$ we have $$G(K_R,K_G,K_B) \cap G(K''_R,K''_G,K''_B) \subseteq G_{min} = G(\min(K_R,K''_R),\min(K_G K''_G),\min(K_B,K''_B)).$$

Figure 10:
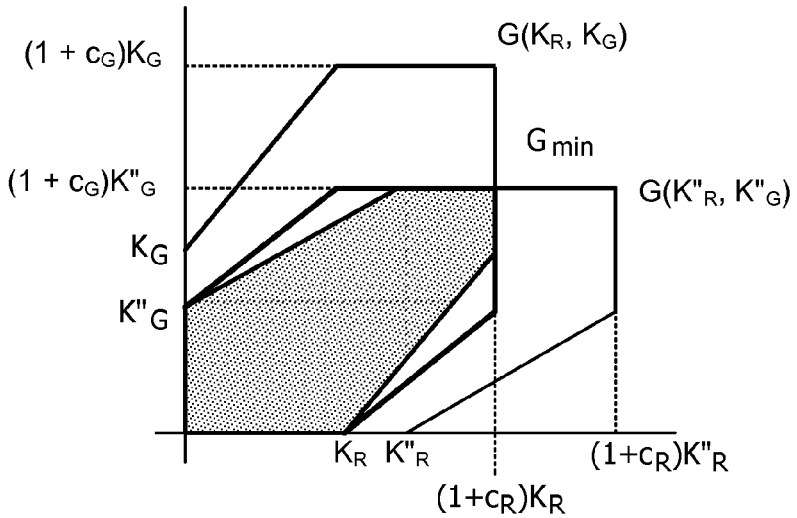
FIG. 10 is an illustration of a two-dimensional gamut for an RGBW display.

Proof of Lemma 1: Due to Postulate 1 it suffices to proof the lemma for projections $G(K_R, K_G)$, $G(K_R, K_B)$ and $G(K_G, K_B)$. FIG. 10, (wherein $G(\min(K_R, K''_R), \min(K_G K''_G)$, marked by thick line, contains the intersection of $G(K_R, K_G)$ and $G(K''_R, K''_G)$, highlighted in gray) illustrates that $$G(K_R,K_G) \cap G(K''_R,K''_G) \subseteq G(\min(K_R,K''_R,\min(K_G K''_G).$$

Similarly $G(\min(K_R, K''_R), \min(K_B K''_B))$ contains $G(K_R, K_B) \cap G(K''_R, K''_B)$, and $G(\min(K_G, K''_G), \min(K_B K''_B))$ contains $G(K_G, K_B) \cap G(K''_G, K''_B)$. Thus we have the lemma.

Proof of Theorem 1: Suppose that there exist two different minimal gamuts for the set of colors S, $G(K_R, K_G, K_B)$ and $G(K''_R, K''_G, K''_B)$. Then $S \subseteq G(K_R, K_G, K_B) \cap G(K''_R, K''_G, K''_B)$ and according to Lemma 1, $S \subseteq G_{min} = G(\min(K_R, K''_R), \min(K_G K''_G), \min(K_B, K''_B))$. Since $S \subseteq G_{min}$, $G_{min} \subseteq G(K_R, K_G, K_B)$ and $G(K_R, K_G, K_B)$ is minimal, we have $G_{min} = G(K_R, K_G, K_B)$. Similarly $G_{min} = G(K''_R, K''_G, K''_B)$. Hence $G(K_R, K_G, K_B) = G(K''_R, K''_G, K''_B)$ which contradicts the assumption that $G(K_R, K_G, K_B)$ and $G(K''_R, K''_G, K''_B)$ are two different gamuts. Thus the minimal gamut for set of colors S is unique.

The following will describe the specific exemplary algorithm in more detail

The algorithm starts with a set of backlight intensities in the form of a triple $K_R$, $K_G$, $K_B$ such that $G(K_R, K_G, K_B)$ contains S (the set of color points). This initial set is determined in steps 701 and 703. The algorithm then iteratively decreases $K_R$, $K_G$, $K_B$ to the minimal possible values which determine the minimal gamut, corresponding to steps 705-709.

Let $M_R$, $M_G$, $M_B$ be the maximal possible RGB colors, so that an arbitrary S is always contained in the cube $[0,M_R]\times[0,M_G]\times[0,M_B]$. We define the initial triple $K_R^0$, $K_G^0$, $K_B^0$ as $K_R^0=M_R$, $K_G^0=M_G$, and $K_B^0=M_B$ (for example, for 8-bit color channels, we take $K_R^0=255/d_R$, $K_G^0=255/d_G$, $K_B^0=255/d_B$). Clearly S is inside $G(K_R^0, K_G^0, K_B^0)$. Now we search for minimal $K_R^1$ the such that $G(K_R^1, K_G^0, K_B^0)$ still contains S.

First we derive a formula for computing $K_R^1$ from the image colors S and the values of $K_G^0$, $K_B^0$. Since $S\subseteq G(K_R^0, K_G^0, K_B^0)$, it is not that difficult to establish that $$K_R^1 = \operatorname*{argmin}_K\{S \in G(K, K_G^0, K_B^0)\}$$
$$= \max_{(r,g,b)\in S} \operatorname*{argmin}_K\{(r, g, b) \in G(K, K_G^0, K_B^0)\}$$

which is according to postulate 1 is equal to $$\max_{(r,g,b)\in S} \max\left(\operatorname*{argmin}_K\{(r, g) \in G(K, K_G^0)\}, \operatorname*{argmin}_K\{(r, b) \in G(K, K_B^0)\}\right)$$

where $G(K, K_G^0)$ and $G(K, K_B^0)$ are projections of $G(K, K_G^0, K_B^0)$ on the plains RG and RB respectively.

Thus, in the algorithm the minimum required backlight intensity for the Red backlight for a color point can be determined individually for the different possible pairs of light sources (RG and RB respectively). The backlight intensity for the Red backlight for the color point is then selected as the highest of the determined minimum values. It will be appreciated that the same approaches can be applied to the determination of the other light source intensities.

A specific example of the principle of finding the minimum intensity value for the green backlight is described with reference to FIG. 11 which illustrates the color points in the two-dimensional gamut. For any value of the control factors Kr, Kg, Kb and thus the corresponding intensities KR, KG, KB generated by the light sources LR, LG, LB, respectively, the reproduction gamut is defined by the primaries PR, PG, PB and PW. These primaries PR, PG, PB, PW are vectors in the display color space defined by the three-dimensional color space RGB. For clarity and brevity, only the two-dimensional color sub-space SRG is shown in FIG. 11.

The vector $dG\cdot K^0G$ illustrates the initial value Gi of the primary PG, the vector $dR\cdot K^0R$ illustrates the initial value Ri of the primary PR (determined in step 703). These initial values Gi and Ri are found by first determining for each color of the input image, the minimal intensity value for the corresponding color primary PG, PR based on only the single light source and ignoring the white sub-pixel and the selecting the maximum value of the minimal intensity values found.

Figure 11:
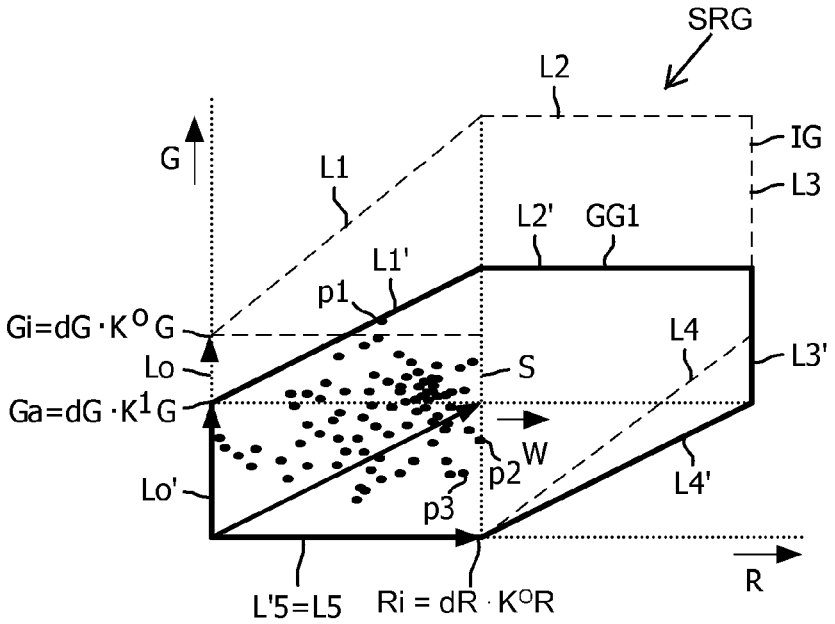
FIG. 11 is an illustration of a two-dimensional gamut for an RGBW display.

Each color point in the set S is represented by one of the dots shown in FIG. 11. The initial value Gi is found by determining for all the dots shown, the minimal value of the primary PG required for the green part of the color of the point (from only the Green light source and sub-pixel). As is clear from FIG. 11, the maximum value of these minimum values is found for the color P1. Consequently, the initial value Gi has the same G value as the G value of this color P1. Analogously, the initial value Ri is equal to the R value of the color P2 which has the largest R value of all the colors. The resulting initial gamut is indicated by IG which clearly is substantially larger than the required gamut for the color point S. The boundary of the gamut IG is the convex hull defined by the vectors $dR\cdot K^0R$, $dG\cdot K^0G$, $dB\cdot K^0B$, $CR\cdot K^0R+CG\cdot K^0G+CB\cdot K^0B$. The actual color R', G', B', W' presented to the viewer is defined by:

$$(a\cdot dR+d\cdot CR)K^0R,(b\cdot dG+d\cdot CG)K^0G,(c\cdot dB+d\cdot CB)K^0B$$

where a, b, c, d are the control factors which determine the amount of transmission of the attenuation elements of the transmission components corresponding to the sub-pixels RP, GP, BP, WP, respectively. The control factors a, b, c, d may vary from zero to one.

Starting from the initial gamut IG, the minimal value of the primary PG is determined such that all color points are inside the associated minimal gamut. It can easily be seen in FIG. 11 that decreasing the primary PG starting from the initial value Gi changes the position of most of the line parts L0, L1, L2, L3, L4, L5 which indicate the boundary of the initial gamut IG. The resulting line parts L0', L1', L2', L3', L4', L5' indicate the boundary of the minimal gamut GG1 obtained when only the primary PG is minimized. The minimal gamut GG1 is found by decreasing the intensity for the primary PG until the first color point touches a boundary of the gamut GG1. In the example shown, this is the color P1. For the sake of clarity, this color P1 is shown just below the line L1' although it should lie on this line. The minimal value of the primary PG is $Ga:=dG\cdot K^1G$.

The minimum green backlight intensity is thus calculated for all the color points based on an assumption that the Red and Blue backlights have the intensity values previously calculated. Thus, the calculation of the minimum required green backlight intensity for a given color point is thus determined by calculating the green backlight intensity that will result in the color point being on a gamut boundary of a gamut that is defined by the calculated green backlight intensity together with the previously calculated red and blue backlight intensities.

It will be appreciated that the same description applies equivalently to the red and blue backlights.

Thus, in order, to compute $$\operatorname*{argmin}_K\{(r, g) \in G(K, K_G^0)\}$$

we should find K such that (r,g) is on the upper boundary of $G(K, K_G^0)$.

Figure 12:
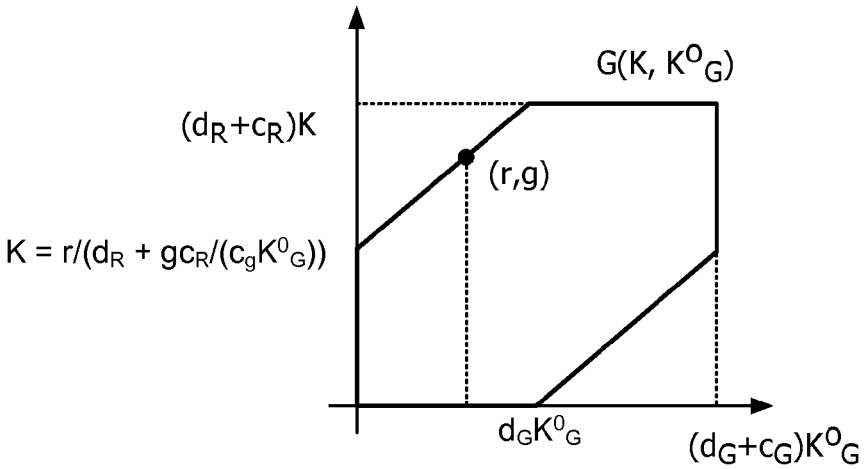
FIG. 12 is an illustration of a two-dimensional gamut for an RGBW display.
Figure 12:
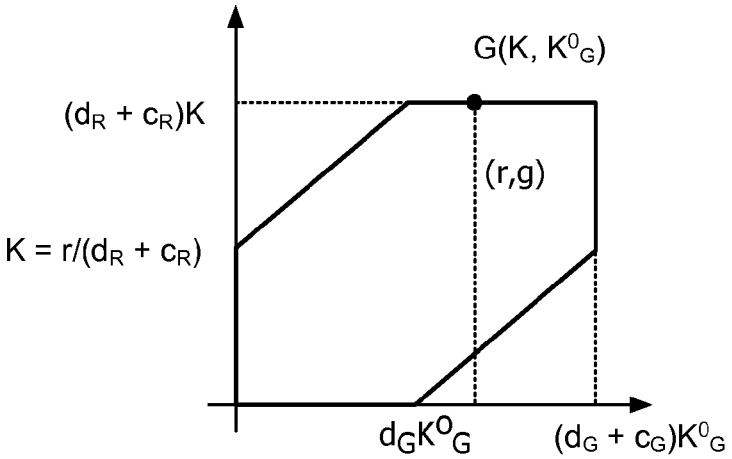

Since the upper boundary consists of two segments, inclined and horizontal, we should consider two cases, as illustrated in FIG. 12.

If $g<c_GK_G^0$, (r,g) belongs to the inclined segment with end points $(0, d_RK)$ and $(c_GK_G^0, (d_R+c_R)K)$. In order to determine K we consider line equation $r/(d_RK)-gc_R/(c_GK_G^0)=1$, from which we derive $K=r/(d_R+gc_R/(c_GK_G^0))$.

If $g\geq c_GK_G^0$(r,g) belongs to horizontal segment with end points $(c_GK_G^0, (d_R+c_R)K)$ and $((d_G+c_G)K_G^0, (d_R+c_R)K)$. The line equation of this segment is $r/((d_R+c_R)K)=1$, from which we derive $K=r/(c_R+d_R)$.

This leads to $$\underset{K}{\operatorname{argmin}}\{(r, g) \in G(K, K_G^0)\} = \begin{cases} r/(d_R + gc_R/(c_G K_G^0)), & \text{if } g < c_G K_G^0, \\ r/(d_R + c_R), & \text{if } g \geq c_G K_G^0, \end{cases}$$
$$= \frac{r}{d_R + c_R \cdot \min\left(1, \frac{g}{c_G K_G^0}\right)}.$$

Thus, the minimum color intensity for a pair of light sources (in this case the Red backlight) can be determined as a function of a color point value corresponding to the first light source (r), a color point value corresponding to the second colored light source (g), a transmission coefficient ($d_R$) for the first light source for a transmission component corresponding to the first light source, a transmission coefficient ($C_R$) of the white transmission component for the first colored light source, a transmission coefficient ($C_G$) of the white transmission component for the second colored light source, and a backlight intensity ($K_G$) for the second colored light source determined in the previous iteration.

Analogously, the same approach can be applied to the other light source pairs, namely $$\underset{K}{\operatorname{argmin}}\{(r, b) \in G(K, K_B^0)\} = \begin{cases} r/(d_R + bc_R/(c_B K_B^0)), & \text{if } b < c_B K_B^0, \\ r/(d_R + c_R), & \text{if } b \geq c_B K_B^0. \end{cases}$$
$$= \frac{r}{d_R + c_R \cdot \min\left(1, \frac{b}{c_B K_B^0}\right)}$$

and therefore $$K_R^1 = \max_{(r,g,b)\in S} \max\begin{pmatrix} \underset{K}{\operatorname{argmin}}\{(r, g) \in G(K, K_G^0)\}, \\ \underset{K}{\operatorname{argmin}}\{(r, b) \in G(K, K_B^0)\} \end{pmatrix}$$
$$= \max_{(r,g,b)\in S} \frac{r}{d_R + c_R \min(t_G^0, t_B^0)},$$

where $$t_G^0 = \min\left(1, \frac{g}{c_G K_G^0}\right),$$

$$t_B^0 = \min\left(1, \frac{b}{c_B K_B^0}\right).$$

It should be noted that that in accordance with this approach $K_R^1$ can be computed from the image color points S and the values of $K_G^0$, $K_B^0$ in a single iteration over the colors points S. Thus, the calculation of the red backlight intensity value can be performed independently of the calculation of the Green and Blue backlight intensity values in the same iteration.

In the described approach the same approach is applied to the other light sources (backlight colors). Specifically:

$$K_G^1 = \max_{(r,g,b)\in S} \underset{K}{\operatorname{argmin}}\{(r, g, b) \in G(K_R^0, K, K_B^0)\},$$

$$K_B^1 = \max_{(r,g,b)\in S} \underset{K}{\operatorname{argmin}}\{(r, g, b) \in G(K_R^0, K_G^0, K)\}.$$

Thus, the calculation of the minimum Green and Blue backlight intensity values is also independent of the current iteration calculation of these values. In other words, in order to compute the set of backlight intensities $K_R^1$, $K_G^1$, $K_B^1$ in the current iteration, it is only necessary to know $K_R^0$, $K_G^0$, $K_B^0$ which have all been calculated in the previous iteration. Accordingly, the triple $K_R^1$, $K_G^1$, $K_B^1$ can be computed in a single iteration/loop over the color points S. Since all three gamuts $G(K_R^1, K_G^0, K_B^0)$, $G(K_R^0, K_G^1, K_B^0)$ and $G(K_R^0, K_G^0, K_B^1)$ contain S, and $K_R^1 \leq K_R^0$, $K_G^1 \leq K_G^0$, $K_B^1 \leq K_B^0$ then according to the lemma also $G(K_R^1, K_G^1, K_B^1)$ contains S.

In the next iteration the algorithm then determines the set of backlight intensities $K_R^2$, $K_G^2$, $K_B^2$ $$K_R^2 = \max_{(r,g,b)\in S} \underset{K}{\operatorname{argmin}}\{(r, g, b) \in G(K, K_G^1, K_B^1)\},$$

$$K_B^2 = \max_{(r,g,b)\in S} \underset{K}{\operatorname{argmin}}\{(r, g, b) \in G(K_R^1, K, K_B^1)\},$$

$$K_B^2 = \max_{(r,g,b)\in S} \underset{K}{\operatorname{argmin}}\{(r, g, b) \in G(K_R^1, K_G^1, K)\}.$$

In the third iteration $K_R^3$, $K_G^3$, $K_B^3$ are determined etc so on.

This allows for a highly efficient algorithm with a reduced number of iterations. In particular, it allows all backlight intensities for a given color point to be calculated together without relying on the current iteration backlight intensity of any of the other colors. As a number of the parameters and values that are calculated are common for more than one light source/backlight color this may further provide a highly efficient calculation In the following it will be shown that the described approach will converge towards the minimum gamut.

Theorem 2. The triple $K_R^k$, $K_G^k$, $K_B^k$ converges, as k grows, to the triple of the minimal gamut.

Proof. Indeed, since $K_R^k$, $K_G^k$, $K_B^k$ are non-increasing in k and bounded from below, they converge to some limits $K_R^{min}$, $K_G^{min}$, $K_B^{min}$. Since $G(K_R^{min}, K_G^{min}, K_B^{min})$ is a closed set in Euclidean space there are no colors of S outside $G(K_R^{min}, K_G^{min}, K_B^{min})$ and $K_R^{min}$, $K_G^{min}$, $K_B^{min}$ cannot be decreased without losing this property. Thus $G(K_R^{min}, K_G^{min}, K_B^{min})$ is the minimal gamut.

The above thus describes a highly efficient gamut control. For example, in comparison to the approach described in European Patent Application EP 07826380, the current approach requires three times less iterations over the color points S in order to compute the minimal backlight intensity set. Moreover the computation of $K_R^k$, $K_G^k$, $K_B^k$ within one iteration requires fewer operations than their sequential computation in this approach.

Indeed, the set of backlight intensities can be determined as:

$$(K_R^k, K_G^k, K_B^k) = \left(\max_{(r,g,b)\in S} \frac{r}{d_R + c_R \cdot \min(t_G^{k-1}, t_B^{k-1})}, \right.$$
$$\left. \max_{(r,g,b)\in S} \frac{g}{d_G + c_G \cdot \min(t_R^{k-1}, t_B^{k-1})}, \max_{(r,g,b)\in S} \frac{b}{d_B + c_B \cdot \min(t_R^{k-1}, t_G^{k-1})}\right),$$

where $$t_R^{k-1} = \min\left(1, \frac{r}{c_R K_R^{k-1}}\right),$$

$$t_G^{k-1} = \min\left(1, \frac{g}{c_G K_G^{k-1}}\right),$$

$$t_B^{k-1} = \min\left(1, \frac{b}{c_B K_B^{k-1}}\right).$$

The above formula may allow a very compact implementation. An example of a pseudo code program for implementing this approach is provided in the following:

```
% Define transparency parameters of the color filters
dr=1; dg=1; db=1; cr=1; cg=1; cb=1;
% initialize Kr, Kg, Kb by the max possible image values
Kr = 255/dr; Kg = 255/dg; Kb = 255/db;
% extract R, G and B channels from the image
R=Image(:,1); G=Image(:,2); B=Image(:,3);
% define number of iterations 1 - low-cost, 2 - OK, 3 - ideal
n_iter = 2;
for iter=1:n_iter % for every iteration,
    % initialize new Kr, Kg, Kb
    mxkr=0; mxkg=0; mxkb=0;
    for ix=1:size(R), % for every pixel,
R_temp=min(1.0,R(ix)/(cr·Kr));
        G_temp=min(1.0,G(ix)/(cg·Kg));
        B_temp=min(1.0,B(ix)/(cb·Kb));
kr_temp=R(ix) /(dr+cr·min(G_temp,B_temp));
kg_temp =G(ix)/(dg+cg·min(R_temp,B_temp));
kb_temp =B(ix)/(db+cb·min(R_temp,G_temp));
mxkr = max(mxkr, kr_temp);
mxkr = max(mxkg, kg_temp);
mxkr = max(mxkb, kb_temp);
    end
    Kr=mxkr;   Kg=mxkg;   Kb=mxkb;
end
```

In the example above the threshold applied when selecting the set of backlight intensities for the current iteration was selected to ensure that all color points could be represented. Thus, in the example where the representation criterion corresponds to a requirement that the color point is within the gamut created by the primaries for the determined backlight intensities, no clipping of any color points result.

However, in other embodiments, it may be advantageous to allow clipping of some of the color points. For example, in some embodiments, it may be advantageous to allow a given number of color points to be outside the gamut created by the primaries for the determined backlight intensities. This may introduce some image degradation or artifacts which however may be acceptable in view of the reduced power consumption. Indeed, in many scenarios the introduced clipping may be negligible or imperceptible.

Thus, in some embodiments, the set of backlight intensities for the current iteration is determined by selecting backlight intensities for each of the colored light sources from the color point backlight intensity sets such that the number of color points for which the color point backlight intensity sets comprise a backlight intensity above a corresponding selected backlight intensity is below a threshold which is higher than one.

The threshold may for example be set to a fixed predetermined number, such as for example 101 color points/pixels. Thus, in such an example the backlight intensities are selected from the color point backlight intensity set such that 100 of the color points will be clipped and thus cannot be accurately represented (in accordance with the selected representation criterion). Thus, for the 100 corresponding pixels, the color representation may only be approximate. However, for most images the clipping of relatively low numbers of the color points will not be perceived as significant image quality degradation. However, it may in many scenarios allow a significant reduction in the backlight intensities and thus the power consumption.

It will be appreciated that the number of color points that may be clipped (i.e. the threshold value) may depend on various parameters. For example, the number of color points clipped may be a relative value with respect to the number of color points considered and may specifically be a fixed proportion of the number of color points. The threshold may for example also be dependent on the resolution of the display panel.

It will also be appreciated that the threshold may comprise individual values for each of the light sources. Thus, a separate threshold for each of the plurality of light sources may be used such as for example a predetermined (absolute or relative) number of color points for the Red backlight, a predetermined (absolute or relative) number of color points for the Green backlight, and a predetermined (absolute or relative) number of color points for the Blue backlight. Thus, in some embodiments the set of backlight intensities for the current iteration may be determined by selecting for each of the colored light sources a backlight intensity from the color point backlight intensity sets such that the number of color points for which the color point backlight intensity sets comprise a backlight intensity for that light source below the selected backlight intensity is below a threshold.

In the following, a specific example will be given wherein the threshold is determined as a fixed proportion of the color points. Furthermore, the threshold is applied separately to each of the light sources, i.e. the approach allows clipping of a fixed proportion of color points for each backlight color. The approach provides a clipping mechanism which gives additional savings in the backlight power, without (unacceptably) compromising the picture quality.

The approach is based on the realization that a minor percentage of pixels can be clipped without introducing visible distortions. This is in particular the case for most practical video content which typically contains a certain noise component.

Let $p_R$, $p_G$, $p_B$ denote the maximal number of points that may be clipped in the R, G, B channels (the individual light sources), so that the maximum number of points that can be clipped is $p_R+p_G+p_B$.

In accordance with the previous example $K_R^1$ was computed as maximum of $$\kappa_R(r, g, b) = \frac{r}{d_R + c_R \cdot \min(t_G, t_B)},$$

over the set s={(r,g,b)}.

However, if the selection is modified such that instead of selecting a maximum value of $\kappa_R(r,g,b)$, the value of $K_R^1$ is selected as the value for which a given number (a threshold number) of color points have higher calculated $\kappa_R(r,g,b)$ a substantially increased backlight power consumption can often be achieved. This may be considered to correspond to modifying S to exclude a (typically small) number of color points. The excluded color points may then be located outside the gamut resulting from the selected value of $K_R^1$ i.e. the points excluded from the computation of the gamut become clipped.

Figure 13:
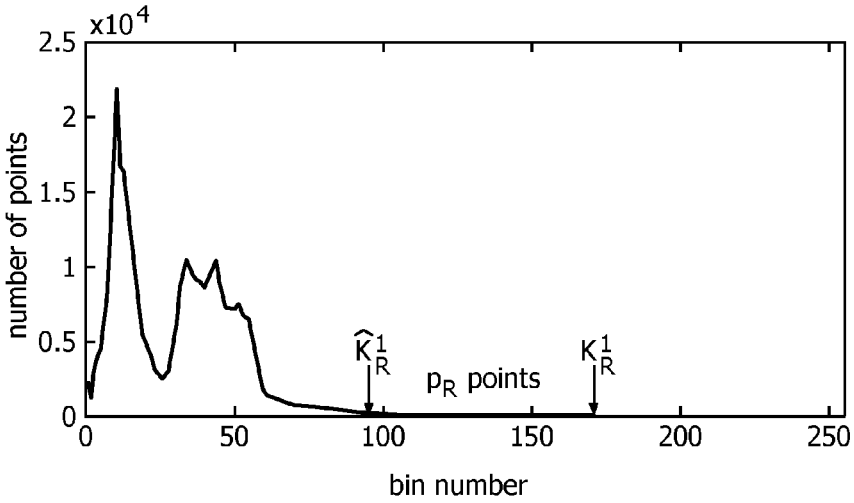
FIG. 13 is an illustration of a histogram of calculated minimum backlight intensities for different color points for an image to be displayed on an RGBW display.

In the example, the color points that are excluded (and thus clipped) are selected as a function of their calculated backlight intensity. Specifically, the histogram of $\kappa_R(r,g,b)$ over the (full) set s={(r,g,b)} is first determined. Subsequently, the minimal $\hat{K}_R^1$ for which there are at most $p_R$ points in the histogram tail after $\hat{K}_R^1$, is then determined (corresponding to the bins of the histogram of $\kappa_R(r,g,b)$ between $\hat{K}_R^1$ and $K_R^1$ in FIG. 13).

Thus, in the specific example, clipping is introduced by reducing $K_R^1$ to $\hat{K}_R^1 \leq K_R^1$ such that all points in the bins corresponding to $\kappa_R(r,g,b)$ between $\hat{K}_R^1$ and $K_R^1$ will be clipped.

The values $\hat{K}_G^1$ and $\hat{K}_B^1$, are computed similarly based on the analysis of histogram tails of $$\kappa_G(r, g, b) = \frac{g}{d_G + c_G \cdot \min(t_R, t_B)},$$

and $$\kappa_B(r, g, b) = \frac{b}{d_B + c_B \cdot \min(t_R, t_G)}.$$

The set of backlight intensities for the iteration are then determined as $\hat{K}_R^1, \hat{K}_G^1, \hat{K}_B^1$. In the next iteration the values $\hat{K}_R^1, \hat{K}_G^1, \hat{K}_B^1$ are then used to calculate first the unclipped values $K_R^2$, $K_G^2$, $K_B^2$ which allow all color points to be represented. Then the same approach is used to calculate backlight intensities that result in clipping $\hat{K}_R^2, \hat{K}_G^2, \hat{K}_B^2$ was used for determining $\hat{K}_R^1, \hat{K}_G^1, \hat{K}_B^1$ in the previous iteration. The set of backlight intensities for the iteration are then determined as $\hat{K}_R^2$, $\hat{K}_G^2$, $\hat{K}_B^2$ and the same approach is used in subsequent iterations.

It can be proved that the algorithm converges.

Theorem 3. The triple $\hat{K}_R^k, \hat{K}_G^k, \hat{K}_B^k$ converges, as k grows to the triple of gamut such that there are at most $p_R$, $p_G$, $p_B$ points clipped in the R, G, B channels.

Proof. The proof is similar to the proof of Theorem 2. The only thing that remains to be established is that $\hat{K}_R^k, \hat{K}_G^k, \hat{K}_B^k$ is non-increasing. To this end let us show, for example, that $\hat{K}_R^2 \leq \hat{K}_R^1$. Indeed the number of clipped points in R channel for $G(\hat{K}_R^1, \hat{K}_G^1, \hat{K}_B^1)$ is less or equal to the number of clipped points in R channel for $G(\hat{K}_R^1, K_G^1, K_B^1)$ which is less or equal to $p_R$, and therefore. A similar argument holds for the other channels.

It should be noted that the histograms can be calculated in the same color point loop as $K_R^k$, $K_G^k$, $K_B^k$ and require the minimum of extra operations. Thus a computationally highly efficient algorithm can be used.

An example of a pseudo code program for implementing this approach is provided in the following:

```
% Define transparency parameters of the color filters
dr=1; dg=1; db=1; cr=1; cg=1; cb=1;
% initialize Kr, Kg, Kb by the max possible image values
Kr = 255/dr; Kg = 255/dg; Kb = 255/db;
% extract R, G and B chanels from the image
R=Image(:,1); G=Image(:,2); B=Image(:,3);
% define number of points to clip in R, G and B channels
to_clip_in_R=ceil(0.01· size(R)); to_clip_in_G=
to_clip_in_R; to_clip_in_B= to_clip_in_R;
% define number of iterations 1 - low-cost, 2 - OK, 3 - ideal
n_iter = 2;
for iter=1:n_iter % for every iteration,
    % determine parameters of histograms and initialize them with zeros
    histR_max=Kr; histG_max=Kg; histB_max=Kb;
    num_bins_R = ceil(Kr)+1; num_bins_G = ceil(Kg)+1;
    num_bins_B = ceil(Kb)+1;
    Hist_R=zeros(1, num_bins_R); Hist_G=zeros(1, num_bins_G);
Hist_B=zeros(1, num_bins_B);
    for ix=1:size(R), % for every pixel,
        R_temp=min(1.0,R(ix)/(cr·Kr));
            G_temp=min(1.0,G(ix)/(cg·Kg));
            B_temp=min(1.0,B(ix)/(cb·Kb));
kr_temp=R(ix) /(dr+cr·min(G_temp,B_temp));
kg_temp =G(ix)/(dg+cg·min(R_temp,B_temp));
kb_temp =B(ix)/(db+cb·min(R_temp,G_temp));
% determine histogram classes and update histograms
kr_cl= ceil((num_bins_R−1)·kr_temp/ histR_max)+1;
kg_cl= ceil((num_bins_G−1)·kg_temp/ histG_max)+1;
kb_cl= ceil((num_bins_B−1)·kb_temp/ histB_max)+1;
        Hist_R(kr_cl)= Hist_R(kr_cl)+1;
        Hist_G(kg_cl)= Hist_G(kg_cl)+1;
        Hist_B(kb_cl)= Hist_B(kb_cl)+1;
```

-continued

```
    end
    % clip colors in the tails of histograms
    index=num_bins_R+1; s= Hist_R(index);
            while s< to_clip_in_R
                index=index−1;
                s=s+ Hist_R(index);
            end
Kr=min(histR_max, (index+1.0)·histR_max/num_bins_R);
index=num_bins_G+1; s=Hist_G(index);
            while s< to_clip_in_G
                index=index−1;
                s=s+Hist_G(index);
            end
    Kg=min(histG_max, (index+1)·histG_max/num_bins_G);
    index= num_bins_B+1; s=Hist_B(index);
            while s< to_clip_in_B
                index=index−1;
                s=s+Hist_B(index);
            end
    Kb=min(histB_max, (index+1)·histB_max/num_bins_B);
end
```

In the above example, the threshold for each light source was determined as a fixed proportion of the color points. A particularly advantageous performance has been found to occur for a threshold of between 0.05% and 0.3% of the total pixels of an image. This tends to provide reduced power consumption with no perceptible degradation of the image quality.

In the specific example, the same threshold was applied in all iterations. However, it will be appreciated that in some embodiments the threshold may be varied between iterations. For example, the threshold may be one except for the last iteration in which the threshold may be set to a suitable proportion of the total number of pixels (e.g. 0.1%). Thus, in such an example, the clipping is only introduced in the last iteration when the final converged values are calculated.

In some embodiments, the threshold may be determined in response to an image characteristic of the image to be displayed.

For example, a noise characteristic for the image may be determined and may be used to adjust the threshold. For example, a known method for estimating a noise level for the input image may be applied and the threshold may be set as a function of this noise level. Specifically, the threshold may be increased for increasing noise levels as an increased noise level is likely to reduce the visual impact of the clipping (since it to some extent is masked by the noise).

In other embodiments, the threshold may be modified in response to a color characteristic of the image. For example, if the input image contains a large concentration of saturated red colors but only a small amount of saturated blue colors, the threshold for the red backlight may be set differently than for the blue backlight.

In some embodiments, the color distribution of the color points may be evaluated and used to control the threshold. For example, it may be determined whether the color points include a (relatively small) number of scattered (in the image) color points with one primary color being dominant or whether the color points tend to be relatively smooth and homogeneous distribution. The threshold may then be set depending on this distribution.

It will be appreciated that any suitable criterion for terminating the iterations may be used. For example, the iterations may be terminated when it is found that the backlight intensities change by less than a certain amount. Alternatively, a fixed number of iterations may often be used. For example, the dynamic gamut control may include e.g. two or three iterations for each input image.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

Preferred embodiments of the invention can be summarized as follows. A method of dynamic gamut control is provided for a display having a multi-spectral (typically multi-color) backlight, and sub-pixels corresponding to the different backlight spectra and at least one common sub-pixel. The display may for example be an RGBW display having an RGB backlight. The method comprises iteratively calculating the minimum required backlight intensities that will allow all (selected) color points of an image to be represented by the display. The determination for a light source of the backlight is based on determinations of intensities determined for other light sources in a previous iteration. In some embodiments, the approach allows for a clipping of a number of the color points. The invention may reduce power consumption while maintaining a high image quality and can be implemented computationally very efficiently.

The invention claimed:

1. A method of dynamic gamut control for a display having a mum-spectrum backlight comprising a plurality of backlight sources with different spectra common for a plurality of pixels, pixels of the plurality of pixels being formed by a group of sub-pixels, each sub-pixel corresponding to a transmission component illuminated by the multi-spectrum backlight, the transmission components for each pixel having particular transmission spectrums to provide a set of color primaries, wherein at least a first transmission component of the transmission components has a transmission spectrum such that an intensity of at least one of the color primaries depends on an intensity of at least two of the plurality of light sources, the method comprising determining, for an image to be displayed, a set of backlight intensities for the plurality of light sources by performing a sequence of iterations, the image to be displayed comprising a plurality of colors corresponding to a set of color points in a color space, each iteration comprising the acts of:

for each of the set of color points, determining a color point backlight intensity set by, for each backlight source of the plurality of backlight sources, determining a minimum backlight intensity allowing a color that corresponds to the color point to meet a representation criterion designating that the color point can be represented by the display when backlight intensities of backlight sources of the plurality of backlight sources other than the backlight source for which the minimum backlight intensity is determined are those of a set of backlight intensities determined in a previous iteration for the color point; and calculating the set of backlight intensities for the current iteration by selecting backlight intensities for each of the plurality of backlight sources from the color point backlight intensity sets such that a number of color points for which the color point backlight intensity set comprise a backlight intensity above a corresponding selected backlight intensity is below a threshold, wherein the determining act determines the color point backlight intensity for all the plurality of backlight sources in parallel during the current iteration using backlight intensities determined in the previous iteration, and wherein the calculating act calculates backlight intensity values for one backlight source of the plurality of backlight sources independent of calculations of backlight intensity values for other backlight sources of the plurality of backlight sources.

2. The method of claim 1 wherein the act of determining a minimum backlight intensity for a first backlight source of the plurality of backlight sources comprises acts of:

determining a minimum backlight intensity for the set of color points for each possible pair of the first backlight source and a different backlight source of the plurality of backlight sources; and selecting a highest minimum backlight intensity from the minimum backlight intensities for the set of color points for each possible pair.

3. The method of claim 2, further comprising the act of determining a first minimum backlight intensity for the first backlight source and a second backlight source for a first color point by determining the first minimum backlight intensity as a function of a color point value corresponding to the first backlight source, a color point value corresponding to the second backlight source, a transmission coefficient for the first backlight source for a transmission component corresponding to the first light source, a transmission coefficient of the first transmission component for the first backlight source, a transmission coefficient of the first transmission component for the second backlight source, and a backlight intensity for the second backlight source determined in the previous iteration.

4. The method of claim 1 further comprising the act of determining a set of backlight intensities by for each of the plurality of backlight sources determining a minimum backlight intensity allowing a corresponding color of all color points to be represented by light from only a single transmission component.

5. The method of claim 1 wherein the threshold is one color point.

6. The method of claim 1 wherein the threshold is higher than one color point.

7. The method of claim 1 further comprising the act of determining the threshold in response to an image characteristic of the image to be displayed.

8. The method of claim 7 wherein the image characteristics is at least one of:

a noise characteristic;

a color characteristic; and a color distribution of the color points.

9. The method of claim 1 wherein the threshold comprises a separate threshold for each of the plurality of light sources.

10. The method of claim 1 further comprising the act of determining the threshold as a fixed proportion of a number of color points in the set of color points.

11. The method of claim 1 wherein the threshold varies between iterations.

12. The method of claim 1 wherein at least one of the transmission components for each pixel has a transmission spectrum providing at least a five times higher attenuation of light from a first of the plurality of backlight sources than for a second of the plurality of backlight sources.

13. The method of claim 1 wherein the transmission components include at least one matching transmission component for each pixel for each of the plurality of light sources.

14. A method of dynamic gamut control for a display having a multi-spectrum backlight comprising a plurality of backlight sources with different spectra common for a plurality of pixels, pixels of the plurality of pixels being formed by a group of sub-pixels, each sub-pixel corresponding to a transmission component illuminated by the multi-spectrum backlight, the transmission components for each pixel having particular transmission spectrums to provide a set of color primaries, wherein at least a first transmission component of the transmission components has a transmission spectrum such that an intensity of at least one of the color primaries depends on an intensity of at least two of the plurality of light sources, the method comprising determining, for an image to be displayed, a set of backlight intensities for the plurality of light sources by performing a sequence of iterations, the image to be displayed comprising a plurality of colors corresponding to a set of color points in a color space, each iteration comprising acts of:

for each of the set of color points, determining a color point backlight intensity set by, for each backlight source of the plurality of backlight sources, determining a minimum backlight intensity allowing a color that corresponds to the color point to meet a representation criterion designating that the color point can be represented by the display when backlight intensities of backlight sources of the plurality of backlight sources other than the backlight source for which the minimum backlight intensity is determined are those of a set of backlight intensities determined in a previous iteration for the color point; and calculating the set of backlight intensities for the current iteration by selecting backlight intensities for each of the plurality of backlight sources from the color point backlight intensity sets such that a number of color points for which the color point backlight intensity set comprise a backlight intensity above a corresponding selected backlight intensity is below a threshold wherein the determining act determines a first minimum backlight intensity for a first backlight source of the plurality of backlight sources for a first color point and comprises determining the first minimum backlight intensity in response to:

$$\frac{v_1}{d_1 + c_1 \cdot \min\left(1, \frac{v_2}{c_2 K_2}\right)},$$

wherein v1 is a color point value corresponding to the first backlight source, v2 is a color point value corresponding to a second backlight source, d1 is a transmission coefficient for the first backlight source for a transmission component corresponding to the first backlight source, c1 is a transmission coefficient of the first transmission component for the first backlight source, c2 is a transmission coefficient of the first transmission component for the second backlight source, and K2 is a backlight intensity for the second backlight source determined in the previous iteration.

15. An apparatus for dynamic gamut control for a display having a multi-spectrum backlight comprising a plurality of backlight sources with different spectra common for a plurality of pixels, each pixel of the plurality of pixels being formed by a group of sub-pixels generated by transmission components illuminated by the multi-spectrum backlight, the transmission components for each pixel having particular transmission spectrums to provide a set of color primaries, wherein at least a first transmission component of the transmission components has a transmission spectrum such that an intensity of at least one of the color primaries depends on an intensity of at least two of the plurality of backlight sources, the apparatus comprising a display driver configured to determine, for an image to be displayed, a set of backlight intensities for the plurality of backlight sources by performing a sequence of iterations, the image to be displayed comprising a plurality of colors corresponding to a set of color points in a color space, each iteration comprising:

for each of the set of color points, determining a color point backlight intensity set by for each backlight source of the plurality of backlight sources determining a minimum backlight intensity allowing a color that corresponds to the color point to meet a representation criterion designating that the color point can be represented by the display when backlight intensities of backlight sources of the plurality of backlight sources other than the backlight source for which the minimum backlight intensity is determined are those of a set of backlight intensities determined in a previous iteration for the color point; and calculating the set of backlight intensities for the current iteration by selecting backlight intensities for each of the plurality of backlight sources from the color point backlight intensity sets such that a number of color points for which the color point backlight intensity set comprise a backlight intensity above a corresponding selected backlight intensity is below a threshold, wherein determining the color point backlight intensity set determines the color point backlight intensity for all the plurality of backlight sources in parallel during the current iteration using backlight intensities determined in the previous iteration, and wherein calculating the set of backlight intensities calculates backlight intensity values for one backlight source of the plurality of backlight sources independent of calculations of backlight intensity values for other backlight sources of the plurality of backlight sources.

16. The apparatus of claim 15, wherein the display drive is further configured to determine a minimum backlight intensity for a first backlight source of the plurality of backlight sources by:

determining a minimum backlight intensity for the set of color points for each possible pair of the first backlight source and a different backlight source of the plurality of backlight sources; and selecting a highest minimum backlight intensity from the minimum backlight intensities for the set of color points for each possible pair.

17. The apparatus of claim 15, wherein the display drive is further configured to determine a first minimum backlight intensity for a first backlight source and a second backlight source for a first color point by determining the first minimum backlight intensity as a function of a color point value corresponding to the first backlight source, a color point value corresponding to the second backlight source, a transmission coefficient for the first backlight source for a transmission component corresponding to the first light source, a transmission coefficient of the first transmission component for the first backlight source, a transmission coefficient of the first transmission component for the second backlight source, and a backlight intensity for the second backlight source determined in the previous iteration.

18. The apparatus of claim 15, wherein the display drive is further configured to determine a first minimum backlight intensity for a first backlight source of the plurality of backlight sources for a first color point and comprises determining the first minimum backlight intensity in response to:

$$\frac{v_1}{d_1 + c_1 \cdot \min\left(1, \frac{v_2}{c_2 K_2}\right)}.$$

wherein v1 is a color point value corresponding to the first backlight source, v2 is a color point value corresponding to a second backlight source, d1 is a transmission coefficient for the first backlight source for a transmission component corresponding to the first backlight source, cl is a transmission coefficient of the first transmission component for the first backlight source, c2 is a transmission coefficient of the first transmission component for the second backlight source, and K2 is a backlight intensity for the second backlight source determined in the previous iteration.

19. The apparatus of claim 15, wherein the display drive is further configured to determine a set of backlight intensities by for each of the plurality of backlight sources by determining a minimum backlight intensity allowing a corresponding color of all color points to be represented by light from only a single transmission component.

20. The apparatus of claim 15, wherein the display drive is further configured to determine the threshold in response to an image characteristic of the image to be displayed, wherein the threshold comprises a separate threshold for each of the plurality of light sources and corresponds to a fixed proportion of a number of color points in the set of color points.

* * * * *